US011596230B2

(12) United States Patent
Horezga

(10) Patent No.: US 11,596,230 B2
(45) Date of Patent: Mar. 7, 2023

(54) UNIVERSAL SHELF BRACKET

(71) Applicant: Andrew Horezga, South Amboy, NJ (US)

(72) Inventor: Andrew Horezga, South Amboy, NJ (US)

( * ) Notice: Subject to any disclaimer, the term of this patent is extended or adjusted under 35 U.S.C. 154(b) by 0 days.

(21) Appl. No.: 17/303,870

(22) Filed: Jun. 9, 2021

(65) Prior Publication Data

US 2022/0395097 A1 Dec. 15, 2022

(51) Int. Cl.
*A47B 96/02* (2006.01)
*A47B 96/06* (2006.01)

(52) U.S. Cl.
CPC ..... *A47B 96/028* (2013.01); *A47B 96/061* (2013.01); *A47B 96/066* (2013.01)

(58) Field of Classification Search
CPC .... A47B 96/066; A47B 96/028; A47B 96/061
USPC .... 108/52, 42, 102, 108, 137, 37, 38, 57.17, 108/57.22, 57.31; 211/134, 186, 153, 211/87.01, 90.01, 119.003, 193, 90.02, 211/187; 248/235, 250, 236, 248, 247, 248/220.1, 239, 241, 224.7; 312/351
See application file for complete search history.

(56) References Cited

U.S. PATENT DOCUMENTS 1,230,999 A * 6/1917 Crist ..... A47B 57/565 248/245
1,779,236 A * 10/1930 Hoegger ..... A47B 96/062 211/90.01
1,816,694 A * 7/1931 Pope ..... F25D 23/067 248/239
2,202,811 A * 6/1940 Carney ..... A47B 96/061 248/217.4
2,657,894 A * 11/1953 Sklenar ..... F25D 23/067 248/239
3,333,555 A * 8/1967 Kapnek ..... A47B 96/066 108/152

(Continued)

FOREIGN PATENT DOCUMENTS

EP 3815576 A1 * 5/2021 ..... A47B 96/066

OTHER PUBLICATIONS

International Search Report dated Jul. 15, 2022 issued in connection with International Application No. PCT/US2022/072837 (2 pages total).

(Continued)

*Primary Examiner* — Christopher Garft
*Assistant Examiner* — Michael McDuffie
(74) *Attorney, Agent, or Firm* — Tatonetti IP

(57) ABSTRACT

The present disclosure provides various examples of a universal mounting bracket for mounting a floating shelf to a flat vertical surface such as a wall. The bracket assembly allows for installing the bracket with a single selected fastener. This is more efficient and allows for the bracket to be installed in the widest variety of vertical assemblies with the most strength possible. The bracket can be installed into a stud wall, hollow drywall space, solid masonry wall, a hollow masonry wall unit, a brick wall, a cinderblock wall, a reinforced masonry wall, a plaster wall, a steel wall assembly or support structure, and any other vertical assembly so long as there is a satisfactory fastener for that assembly. Alternatively, the universal mounting bracket provides a mechanism that facilitates its use as a hook for a multitude of purposes.

16 Claims, 18 Drawing Sheets

(56) References Cited

U.S. PATENT DOCUMENTS 3,527,175 A * 9/1970 Kapnek ..... A47B 96/066 108/152
3,750,238 A * 8/1973 Tanner ..... A47B 57/20 267/176
3,752,088 A 8/1973 Kapnek
4,381,715 A * 5/1983 Forman ..... A47B 96/066 403/329
4,441,433 A 4/1984 Caldwell
4,541,600 A * 9/1985 Vieglins ..... F16B 9/05 248/239
5,186,341 A * 2/1993 Zeid ..... A47B 61/003 211/123
5,197,703 A * 3/1993 Pratolongo ..... A47B 57/04 108/152
5,265,971 A * 11/1993 Duc ..... F16B 12/12 403/231
5,788,200 A 8/1998 Jones
5,845,453 A * 12/1998 Goya ..... F16B 9/058 52/702
5,954,306 A 9/1999 Hoover
6,113,045 A * 9/2000 Kuo ..... A47K 10/10 248/224.7
6,164,610 A 12/2000 Santiago
6,276,648 B1 * 8/2001 Katz ..... A47B 96/066 248/250
6,574,924 B2 * 6/2003 Maniezzo ..... A47F 5/0823 211/90.01
8,020,822 B2 * 9/2011 Goldin ..... A47B 96/021 211/183
8,082,859 B2 * 12/2011 Sevack ..... A47B 96/066 108/152
8,382,051 B2 * 2/2013 Smith ..... A47K 10/10 248/221.11
8,561,550 B2 * 10/2013 Raml ..... A47B 5/00 108/42
9,163,415 B2 10/2015 Nies
9,380,876 B2 * 7/2016 Hsieh ..... F16B 45/00
9,861,198 B2 1/2018 Anderson
10,588,412 B2 * 3/2020 Graber ..... A47B 96/028
11,116,317 B2 * 9/2021 LeBlanc ..... A47B 96/027
2003/0213762 A1 * 11/2003 Chang ..... A47F 5/0807 211/90.01
2007/0125738 A1 6/2007 Sevack

OTHER PUBLICATIONS

Written Opinion of the International Searching Authority dated Jul. 15, 2022 issued in connection with International Application No. PCT/US2022/072837 (4 pages total).

* cited by examiner

UNIVERSAL SHELF BRACKET

BACKGROUND

Shelving is generally used to display or store a wide variety of articles. Shelving is used for that purpose both commercially and privately. The search for the optimum way to elegantly design shelf mounting is a never-ending endeavor. Shelving design considers the need to securely support various loads placed on the shelf and the shelf location in relation to the layout of a room and the fact that shelves can be at eye level and in constant view dictating a desired style or décor.

SUMMARY

Various embodiments provide a universal mounting bracket assembly comprising a geometrically shaped base member having a type of coupling portion; a center bore associated with the geometrically shaped base member, the center bore having a recessed area at the front of the geometrically shaped base member to accommodate a corresponding fastener head, the center bore extends through the geometrically shaped base member to allow the use of a selected fastener to attach it to a vertical surface, and a geometrically shaped complementary member to the geometrically shaped base member having at its base a type of coupling portion; wherein the coupling portion of the geometrically shaped base member is fitted to the coupling portion of the geometrically shaped complementary member thereby to form a single bracket assembly whose axial surface area is uniform.

One embodiment provides a universal mounting bracket assembly wherein the bracket assembly is adapted for assembling a floating shelf in a manner concealing the support elements of the floating shelf within the edge of the shelf.

Another embodiment provides a universal mounting bracket assembly wherein the bracket assembly is adapted for placing shelves on top of the bracket.

Yet, another embodiment provides a mechanism that can be used as a hook for a multitude of purposes, such as hanging an article to dry or for storage.

BRIEF DESCRIPTION OF THE DRAWINGS

To facilitate understanding, identical reference numerals have been used to designate elements having substantially the same or similar structure and/or substantially the same or similar function.

DETAILED DESCRIPTION

Figure 1:
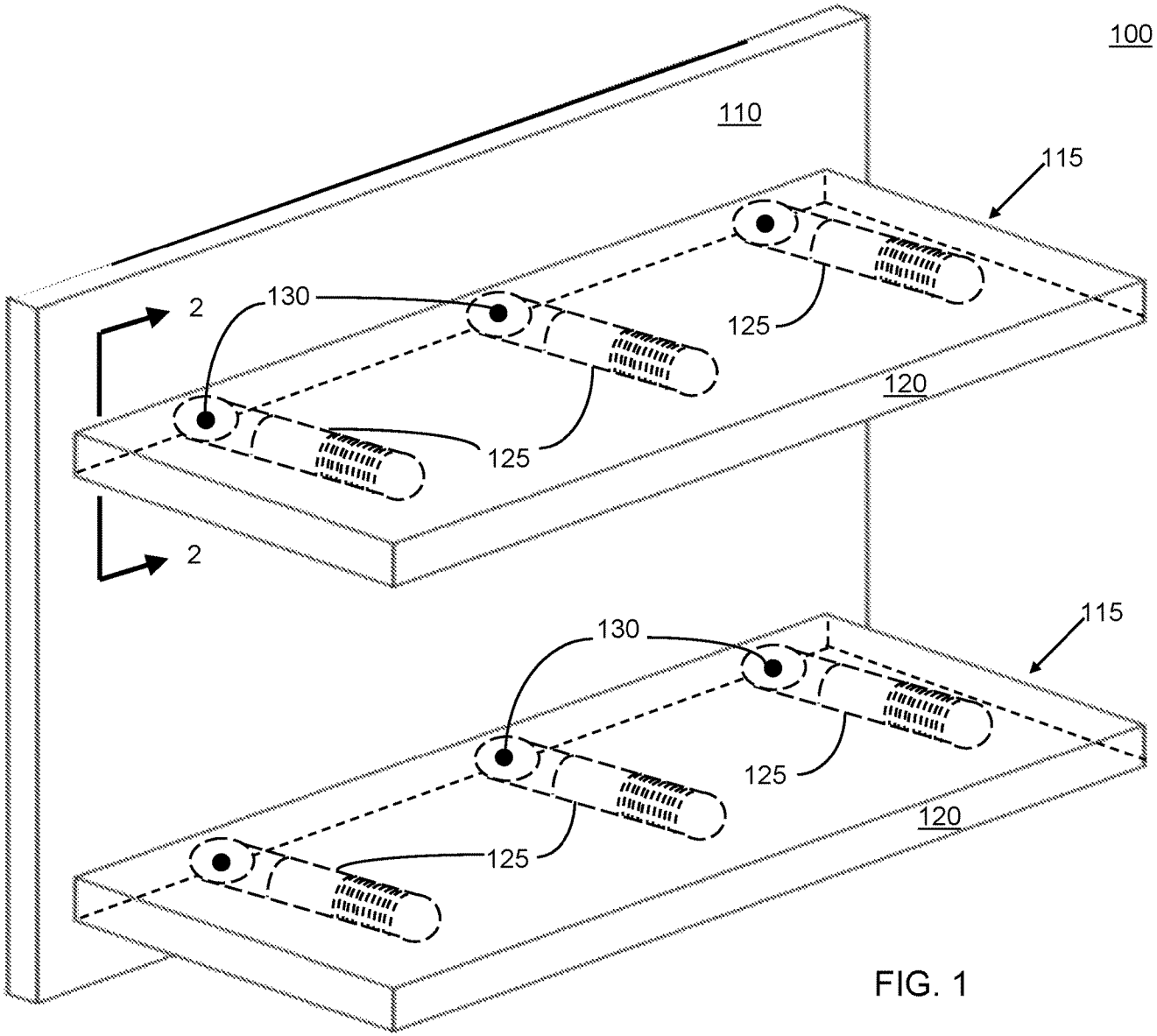
FIG. 1 depicts a perspective view of the floating shelf assembly mounted on a wall.

Although various embodiments, which incorporate the teachings of the present disclosure, are shown and described in detail herein, those skilled in the art can readily devise many other varied embodiments that still incorporate these teachings.

The present disclosure provides various embodiments of a universal mounting bracket for mounting a floating shelf to a flat vertical surface such as a wall assembly. The bracket assembly allows for installing the bracket with a single selected fastener best suited for the vertical surface material on which it is being installed. This is more efficient and allows for the bracket to be easily installed in the widest variety of vertical assemblies with the greatest ease and security. The disclosed embodiments seek to solve the problems associated with installing a floating shelf onto a wall with brackets. Currently, installing a floating shelf comes at the cost of difficult, tedious implementation to properly mount the brackets on a wall. The process also involves complex requirements for constructing the shelf to accommodate the brackets. These factors limit the location on the wall where a shelf may be mounted and require complex manufacturing of the shelf to accommodate the brackets, thereby limiting the type of material that can be used for shelving, where the shelving can be installed and increasing the time, expense and effort to make a floating shelf.

Further, the disclosed embodiments provide configurations for a mounting bracket adapted for easy installation on any wall at any desired location that can assemble with a shelf efficiently and cost-effectively. Moreover, the disclosed embodiments also allow a shelf to be used with the mounting brackets, which does not require complex manufacture to integrate with the bracket. A floating shelf is used to illustrate one of the many uses of the disclosed universal mounting bracket; however, a shelf may be placed on top of the brackets to establish a more traditional shelf décor with the brackets visible. Alternatively, the universal mounting bracket provides a mechanism that facilitates the use of the universal mounting bracket as a peg or hook for hanging an article off of it.

The bracket can be installed onto a stud wall, hollow drywall space, solid masonry wall, a hollow masonry wall unit, a brick wall, a cinderblock wall, a reinforced masonry wall, a plaster wall, a steel wall assembly or support structure, and any other vertical surface of an assembly so long as there is a satisfactory fastener for use with that assembly. This universal mounting bracket user will not have to excessively concern themselves with their wall assembly type when they decide to install a shelf. The disclosed universal mounting bracket allows users to have more freedom to place a shelf where they want. They are not constrained by their wall assembly type or location on the wall where they may desire to place a shelf. The universal mounting bracket may be made of any suitable material including but not limited to metal, plastic, acrylic or glass or any other material known to those skilled in the art.

The universal mounting bracket only requires a simple edge boring, a hole, in the shelf material sufficient to accommodate the diameter and depth of the assembled bracket. Such a hole can be made with a simple drill and bit. The diameter of the hole will circumscribe the geometric shape of the universal mounting bracket. When installed, the universal mounting bracket is concealed in the depth of the hole. Therefore, manufacturing a shelf or mantel for use with the universal mounting bracket does not require complex tools or methods to try and create channels or recesses in the shelf to accommodate bracket plates or flanges or other bracket hardware in order to create a floating shelf effect. Using the universal mounting bracket allows for easier shelf construction and more efficiency in shelf manufacturing. An edge boring can be created with a simple drill press quickly, precisely, and repeatably across large production volumes. Alternatively, a shelf may be placed on top of the universal mounting bracket to create a more traditional shelf installation where the mounting hardware is visible, or may be hung from the universal mounting bracket with a chain or cordage, or the like, to create a hanging shelf style of installation.

Referring now in greater detail to the various figures of the drawings, as shown, FIG. 1 depicts a perspective view of a floating shelf assembly of the instant disclosure mounted on a wall according to an embodiment of the present disclosure. The shelf assembly 115 embodying the universal mounting apparatus disclosed herein generally comprises a universal mounting bracket 125, a selected fastener 130, and a shelf 120, the fastener 130 attaches the universal mounting bracket 125 orthogonally to a vertical surface 110 to accommodate the shelf 120 and therefore shelf assembly 115 is orthogonally attached to the vertical surface 110. Shelf 120 can be of any shelving material such as hardboard, metal, marble, granite, solid surface, built-up laminate, plywood, or solid wood. As will be demonstrated in subsequent illustrations, shelf 120 has one or more holes, which project inwardly from the rear edge. Universal mounting brackets 125 have multiple sections that provide a flush, co-planar apparatus when assembled and installed, allowing for concealment of the bracket in the shelf 120 materials. Additionally, the universal mounting bracket 125 allows for selecting the specific fastener 130 that allows the best match to secure the universal mounting bracket 125 to the vertical surface 110. Also disclosed is a bracket assembly that allows for rapid and easy installation of a horizontal, planarly flat support with simple edge borings.

Figure 2:
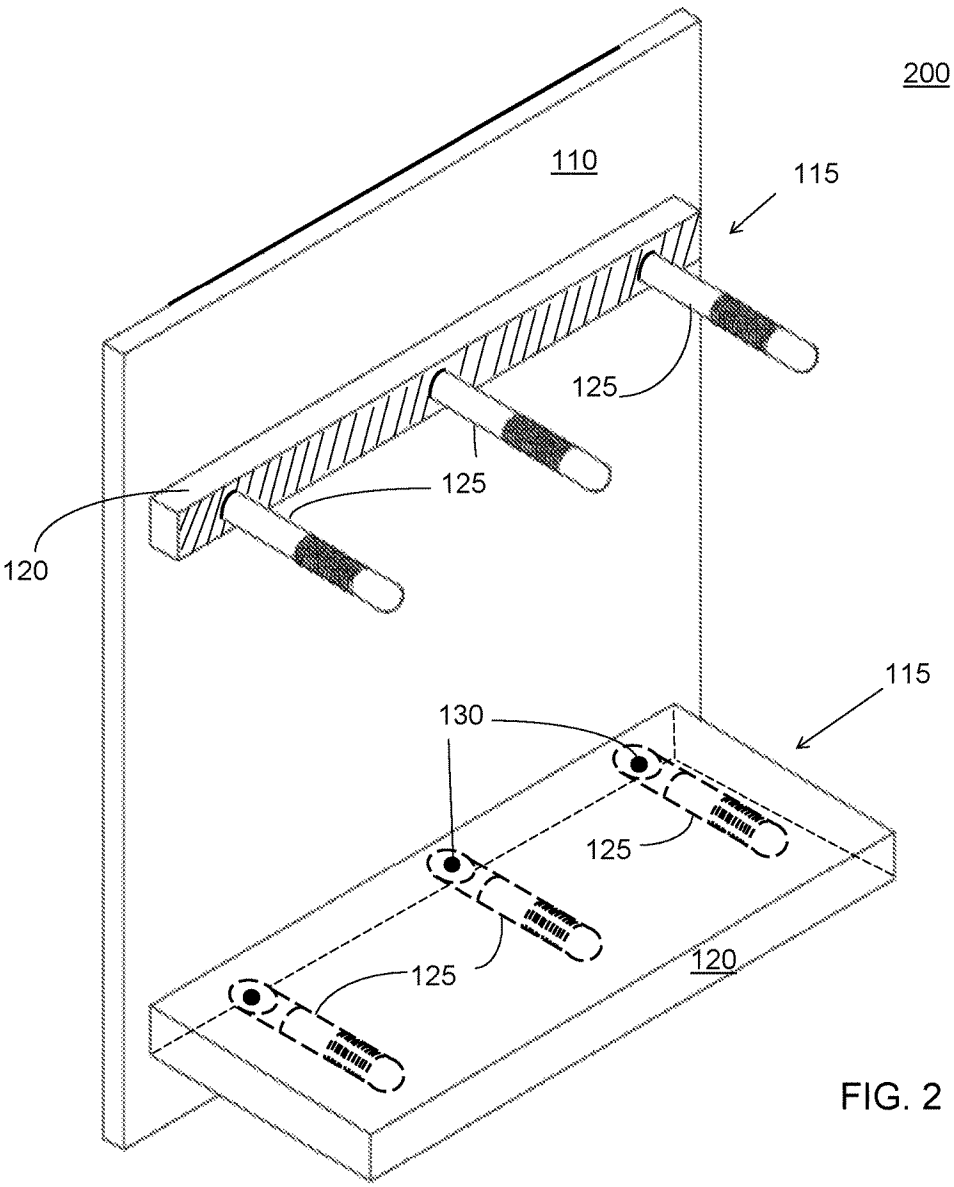
FIG. 2 depicts a cross section of the floating shelf assembly of the instant disclosure mounted on a wall taken along the line of 2-2 of FIG. 1.

FIG. 2 depicts a cross-section of the floating shelf assembly of the instant disclosure mounted on a wall taken along the line of 2-2 of FIG. 1 according to an embodiment of the present disclosure. The universal mounting bracket 125 is seen projecting into the shelf 120 to provide support as it is attached to the vertical surface 110 by selected fastener 130. As shown, the shelf assemblies 115 are attached to vertical surface 110 to facilitate a horizontal shelving design arrangement. In another embodiment, vertical surface 110 is a free-standing structure. The shelf assembly 115 design arrangement can take any form limited only by the user's desires. Such design arrangements could take the shape of a flowing wave-shaped bookshelf or a cross-shaped bookshelf. Shelf assemblies 115 can also be placed in a vertical design arrangement or at an angle or be part of a geometrically designed shape such as a wall box décor. Therefore, the universal mounting bracket 125 can mount a wide variety of desired types of wall décor, including shelves and mantels, while remaining out of visible sight. As disclosed in subsequent figures, alternative embodiments can reflect various geometric shapes of the universal mounting bracket 125 and how the two members of the bracket secure together. For example, the profile of the geometric shape of the universal mounting bracket 125 may be round, hexagonal, or square and may join together by threads, adhesives, magnets, friction, gravity fit profiles, flush set screws, pins, and the like. The length and diameter of universal mounting bracket 125 may also vary according to the type of shelf 120 and load expected to be placed on shelf 120.

Figure 3:
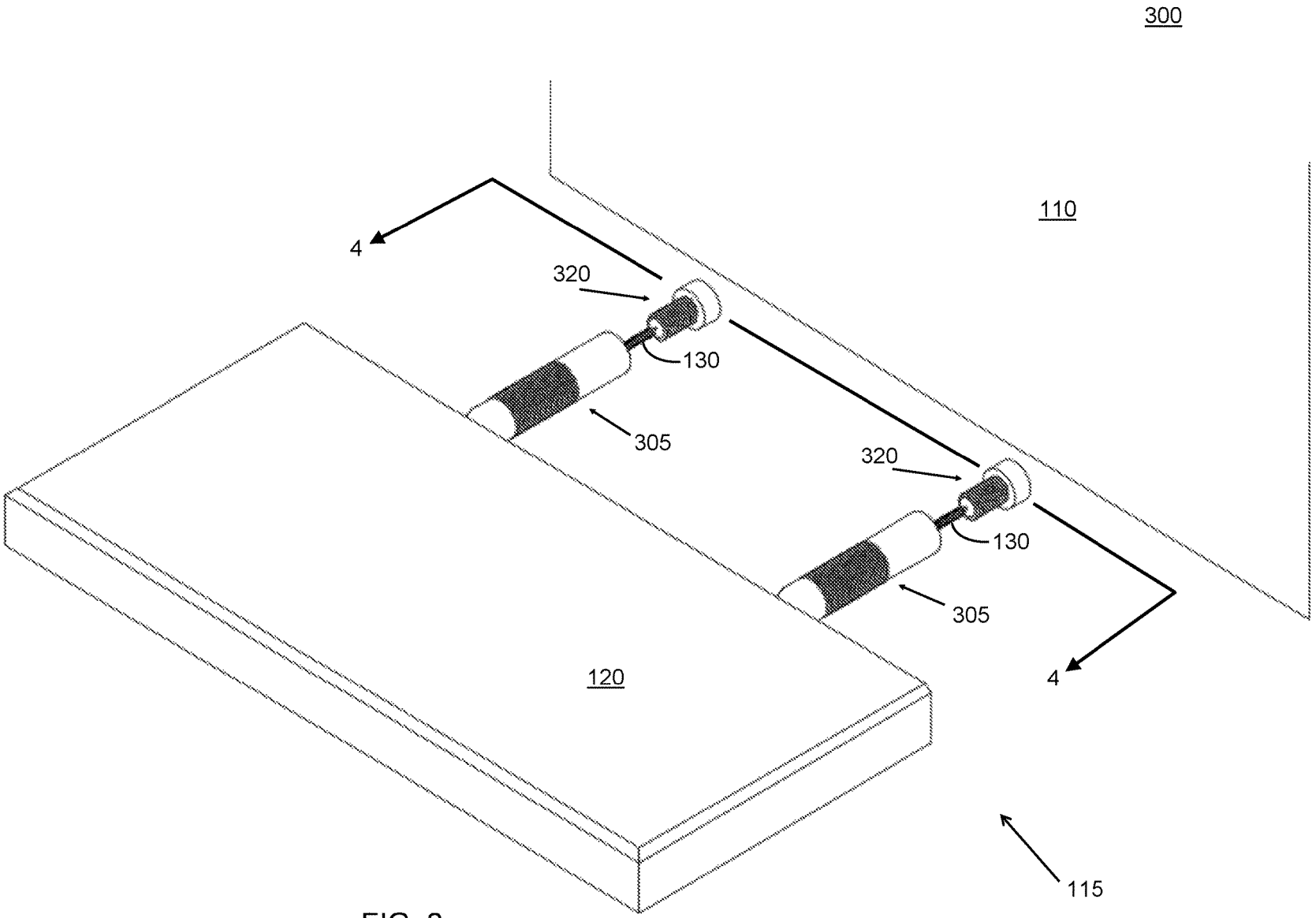
FIG. 3 depicts an exploded view of a universal mounting bracket assembled with shelf and fastener onto a vertical surface.

FIG. 3 depicts an exploded view of a shelf assembly 115 showing how universal mounting bracket 125 stacks with shelf 120 and fastener 130 onto a vertical surface 110 providing an easy installation of a shelf 120 onto any wall assembly at any desired location according to an embodiment of the present disclosure. This view demonstrates that the universal mounting bracket 125 generally comprises a base member 320 and a complementary member 305, which couple together around the fastener 130 to form the universal mounting bracket 125 and conceal the fastener 130. These components are described in greater detail with reference to respective drawings.

Figure 4:
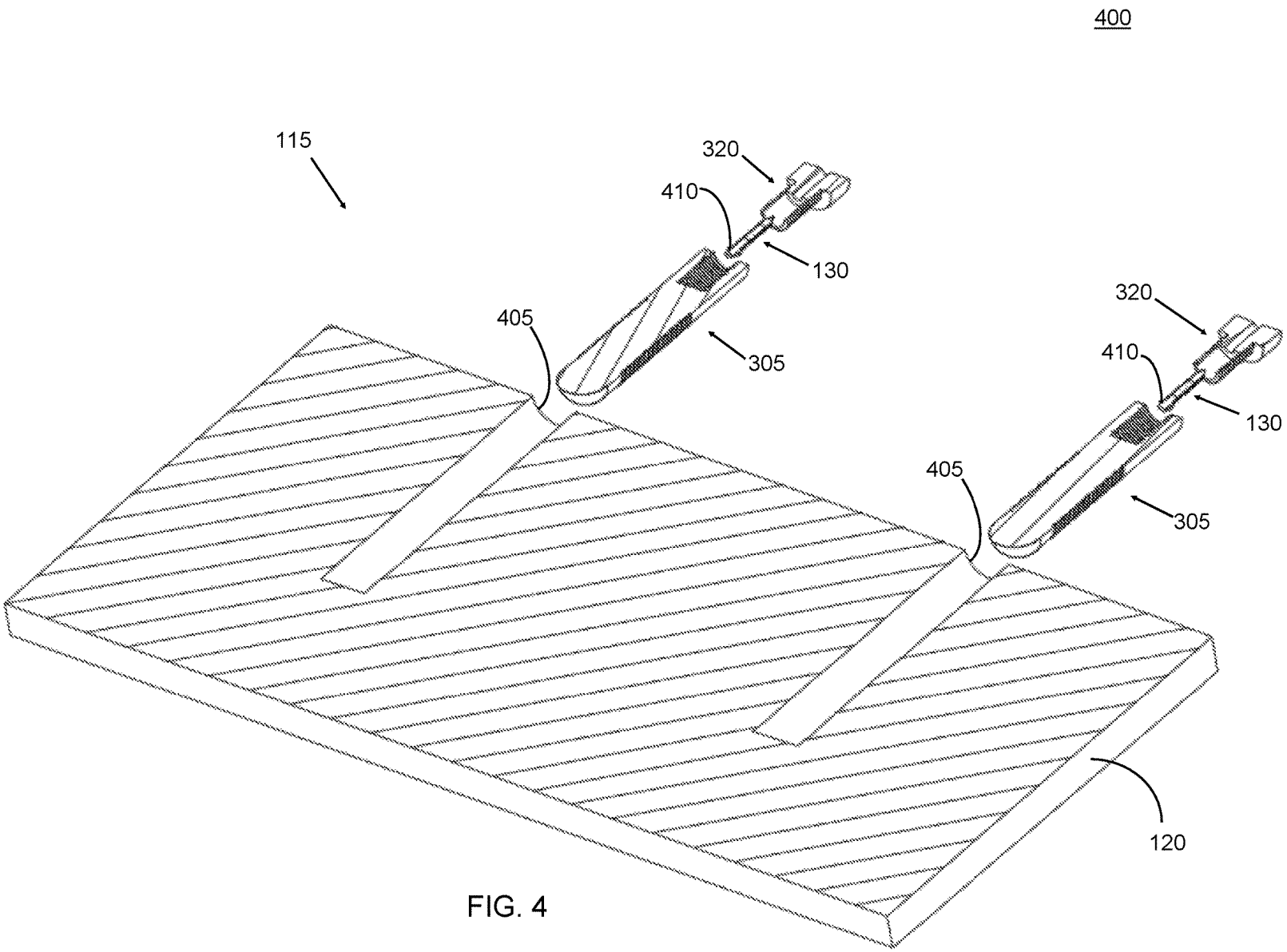
FIG. 4 depicts a cross section of a universal mounting bracket assembled with shelf and fastener onto a vertical surface taken along the line 4-4 of FIG. 3.

FIG. 4 depicts a cross-section of an exploded view of shelf assembly 115 showing how universal mounting bracket 125 stacks with shelf 120 and fastener 130 onto a vertical surface 110 taken along the line 4-4 of FIG. 3 according to an embodiment of the present disclosure. As can be more clearly seen in this figure, base member 320 allows a fastener 130 to pass through the base member 320 and into the vertical surface 110, securing it so that the complementary member 305 may then couple to base member 320 to form the universal mounting bracket 125 which then can be stacked with a shelf 120 to complete the assembly. These components are described in greater detail with reference to respective drawings.

As shown, shelf assembly 115 comprises a shelf 120 with apertures 405 configured to accommodate universal mounting bracket 125. Aperture 405 depth may be equal or greater than the overall length of the universal mounting bracket 125 in order to fully conceal the universal mounting bracket 125 or may be less in-depth than the length of the universal mounting bracket 125 to allow a gap between the shelf 120 and the vertical surface 110 if the user desires that aesthetic in shelf assembly 115. Aperture 405 diameter is equal to or lesser than the diameter of the universal mounting bracket 125 to allow for a snug fit; however, aperture 405 may also be larger in diameter than the diameter of the universal mounting bracket 125 should a user see a need for such an arrangement. The distance between the apertures 405 is project-specific and can be defined by the user of the universal mounting bracket. While two apertures 405 are shown, any number of apertures can be used. For example, some embodiments can include three or more apertures 405. There can be respective apertures 405 for each universal mounting bracket 125. However, the existence of an aperture 405 does not dictate mating the aperture 405 with a universal mounting bracket 125. Once again, it is project-specific and defined by the user, for example, a shelf 120 may instead be placed on top of an installed universal mounting brackets 125 if a user desires that type of aesthetic. FIG. 4 also depicts the fastener head 410 of the selected fastener 130 used with the base member 320 to secure universal mounting bracket 125 to vertical surface 110. The universal mounting bracket 125 allows for a single fastener 130 to attach the universal mounting bracket 125 to a vertical surface 110. This allows for the freedom to choose from a variety of fasteners 130 and allows a user to install the universal mounting bracket 125 onto a freely chosen location on a vertical surface 110.

After the desired number and location of universal mounting brackets 125 are installed by a user, they can easily manufacture a shelf 120 to fit onto the universal mounting brackets 125 to create their shelf assembly 115 by boring apertures 405 on the edge of the chosen shelf 120 material in a manner that corresponds with the location of and will allow the accommodation of the installed universal mounting brackets 125 into the apertures 405 made in the shelf 120. This ability allows for the maximization of creativity and customization in designing and installing shelf assemblies 115 while at the same time providing the most efficient and uncomplicated method for shelf 120 manufacture. The aperture 405 does not require undue complex skills, tools, or processes to create, as a common drill and simple drill bit are capable of creating the aperture 405, which conceals not only the entire universal mounting bracket 125 but also the fastener 130 that is within the base member 320, creating a highly desirable floating shelf assembly 115 in the most straight forward and economical manner. Should a user decide to change the length of a shelf 120 at a period of time after initial installation, all that is needed is to remove the shelf 120, install one or more universal mounting brackets 125 to accommodate the length of the new shelf 120, and then make and install the new longer shelf 120. Should a user desire to change the depth of the shelf 120 at a period of time after initial installation, they can remove shelf 120, remove the initial complementary member 305 and replace it with a longer or shorter complementary member 305 as desired, and then make and install the new shelf 120 of different depth. This allows for greater use and utility of shelf assemblies 115 that use the universal mounting bracket 125. They can be modified over time with the least amount of effort and expense, allowing a user to have freedom in modifying shelf assembly 115 over time to accommodate shifting needs and uses. These components are described in greater detail with reference to respective drawings.

Figures 5, 6:
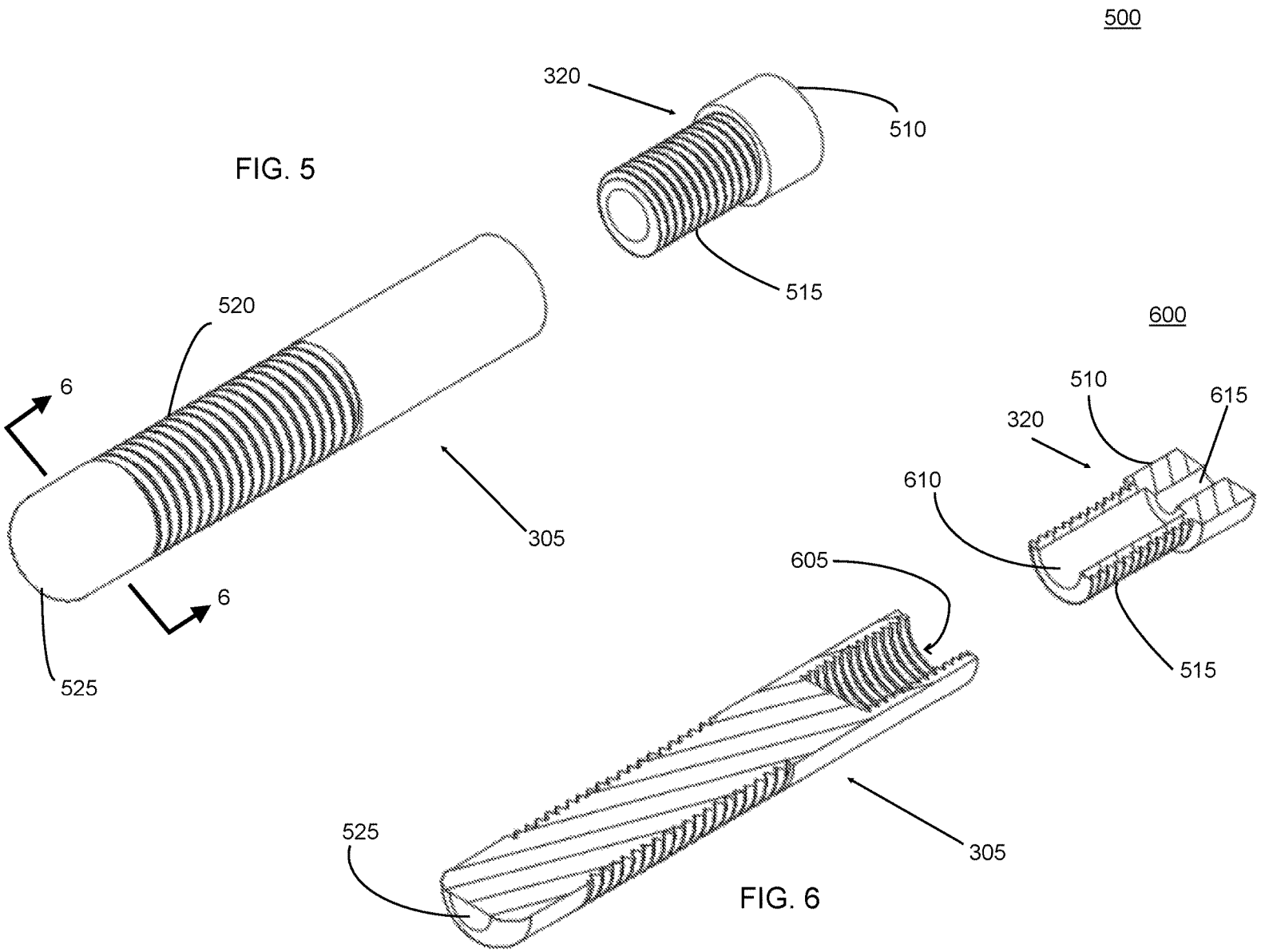
FIG. 5 depicts a mounting bracket apparatus.
FIG. 6 depicts a cross section of the mounting bracket apparatus taken along the line 6-6 of FIG. 5.
Figures 7, 8:
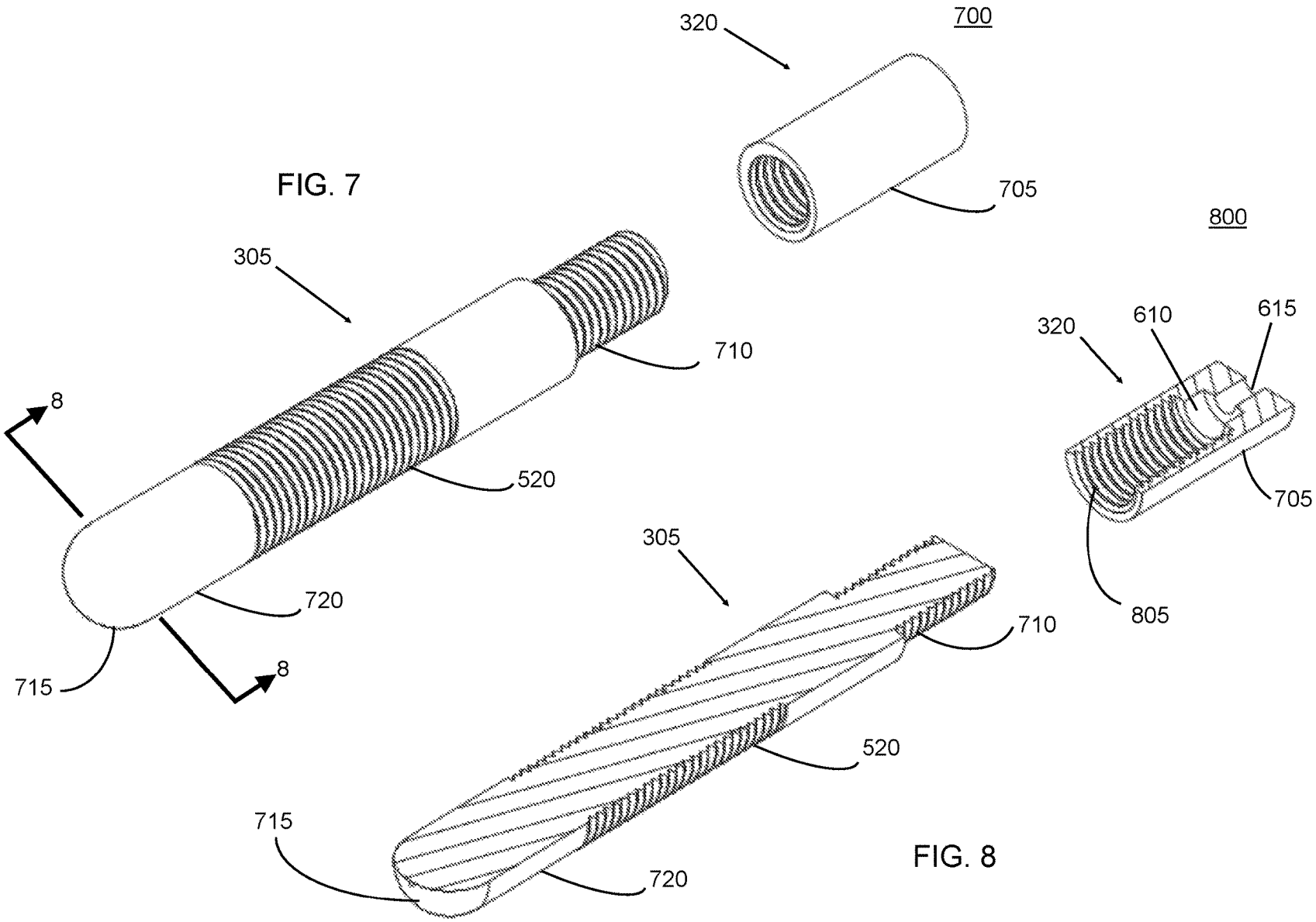
FIG. 7 depicts a threaded female base member and threaded male complementary member.
FIG. 8 depicts a cross section of the threaded female base member and threaded male complementary member taken along the line of 8-8 FIG. 7.
Figures 11, 12:
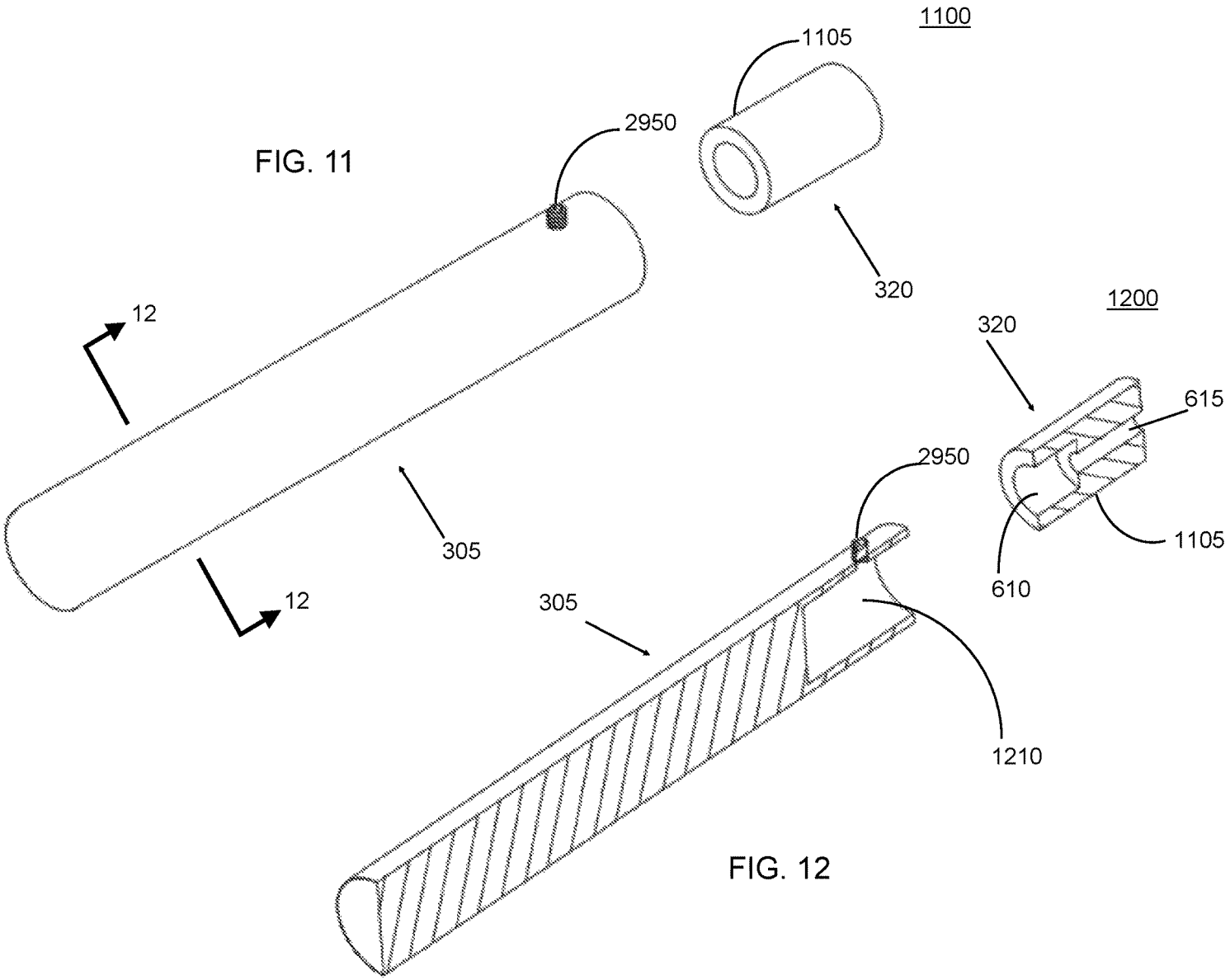
FIG. 11 depicts an unthreaded male base member and unthreaded female complementary member with an aperture accommodating a flush set screw to secure members together.
FIG. 12 depicts a cross-section of the unthreaded male base member and unthreaded female complementary member with an aperture accommodating a flush set screw to secure members together taken along the line of 12-12 of FIG. 11.
Figures 13, 14:
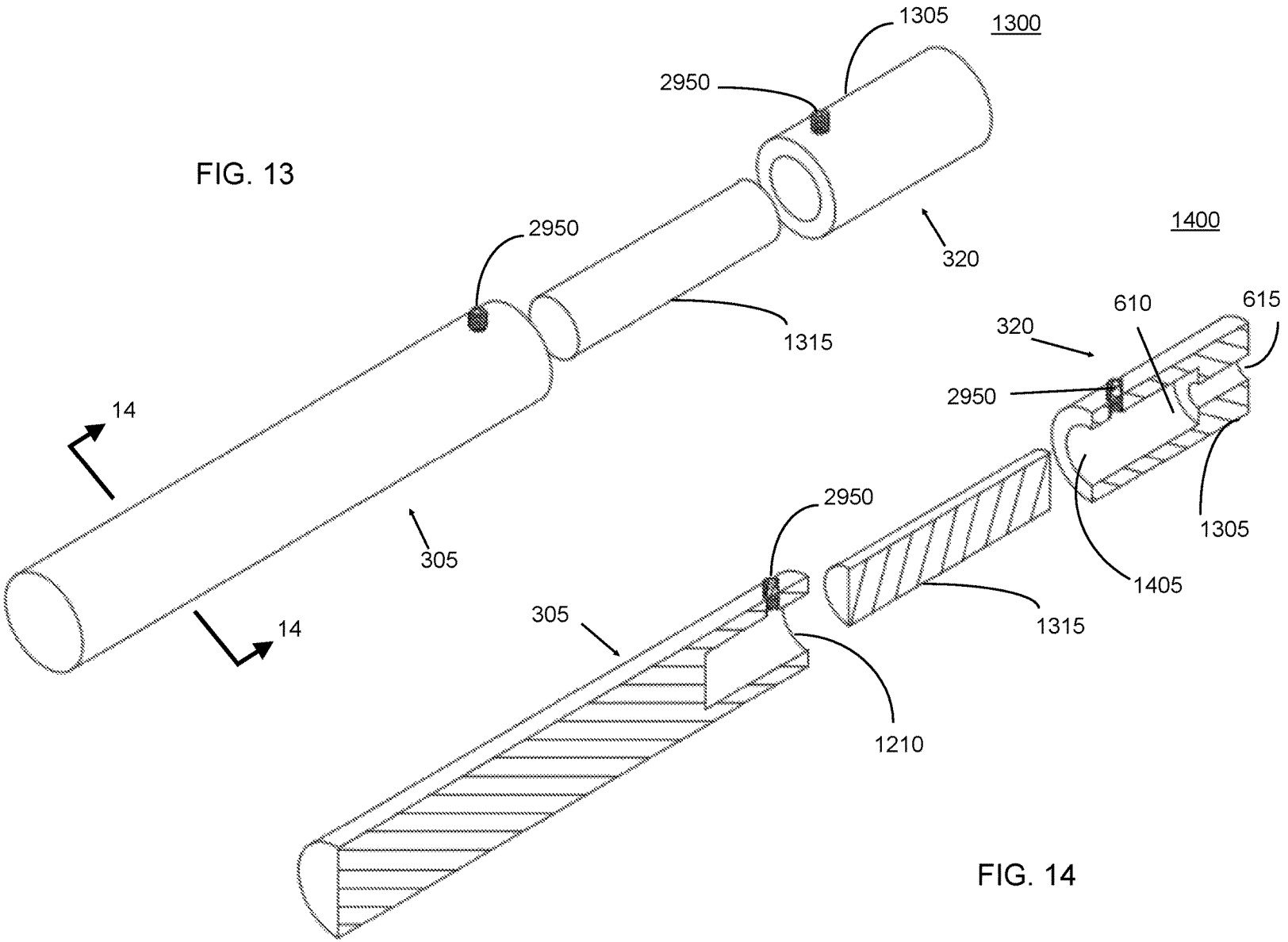
FIG. 13 depicts an unthreaded female base member, unthreaded male interconnecting member and unthreaded female complementary member.
FIG. 14 depicts a cross section of the unthreaded female base member, unthreaded male interconnecting member and unthreaded female complementary member taken along the line 14-14 of FIG. 13.

According to an embodiment of the present disclosure, FIG. 5 depicts a mounting bracket apparatus. This embodiment of the universal mounting bracket 125 shows base member 320 and a complementary member 305. Base member 320 of this embodiment comprises a flange section 510 and a threaded male base coupling portion 515. The surface area of the flange section 510 is uniform with the complementary member 305. These components are described in greater detail with reference to respective drawings. In some embodiments, the overall length of base member 320 is 1.5 inches with a range of 6-153 mm. The same or different lengths can be used in other embodiments without departing from the teachings of this disclosure. The diameter of the flange section 510 is % inch with a range of 6-153 mm. The same or different diameters can be used in other embodiments without departing from the teachings of this disclosure. The overall length for the flange section 510 is ¼ inch with a range of 0-127 mm. The flange section 510 may not be a part of some embodiments; therefore, its lower-dimensional limit is 0 mm to indicate that it might not be present in other base member 320 embodiments. The length of the threaded male base coupling portion 515 is 1 inch with a range of 6-153 mm, and the diameter is ⅝ inch with a range of 6-153 mm. As articulated above, these measurements can be kept the same or changed across embodiments without departing from the teachings of this disclosure. Base members 320 will permanently feature an associated coupling portion across all embodiments in either a male or female configuration. FIG. 5 presents a threaded male base coupling portion 515. The coupling portion of the base member 320 is required for assembly with the complementary member 305 to form the full universal mounting bracket 125. As depicted in FIG. 11 and subsequent figures, base member 320 may have non-threaded male base coupling portion 1105, or as depicted in FIG. 8 and subsequent figures, base member 320 may have threaded female base coupling portion 805 or as depicted in FIG. 14 and subsequent figures, base member 320 may have a non-treaded female base coupling portion 1405.

Figures 9, 10:
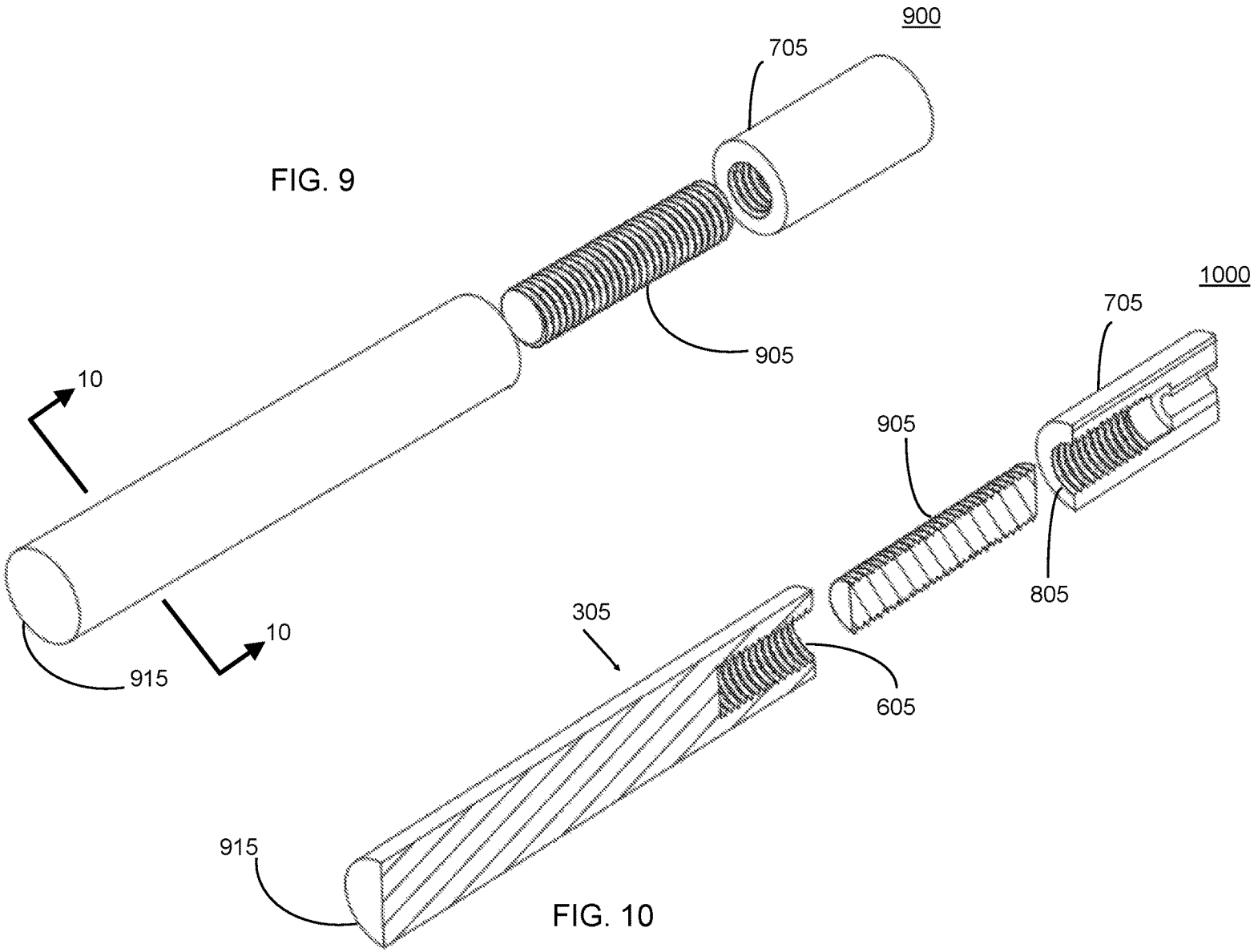
FIG. 9 depicts a female threaded base member, interconnecting threaded male member and female threaded complementary member.
FIG. 10 depicts a cross section of the female threaded base member, interconnecting threaded male member and female threaded complementary member taken along the line of 10-10 of FIG. 9.
Figure 23:
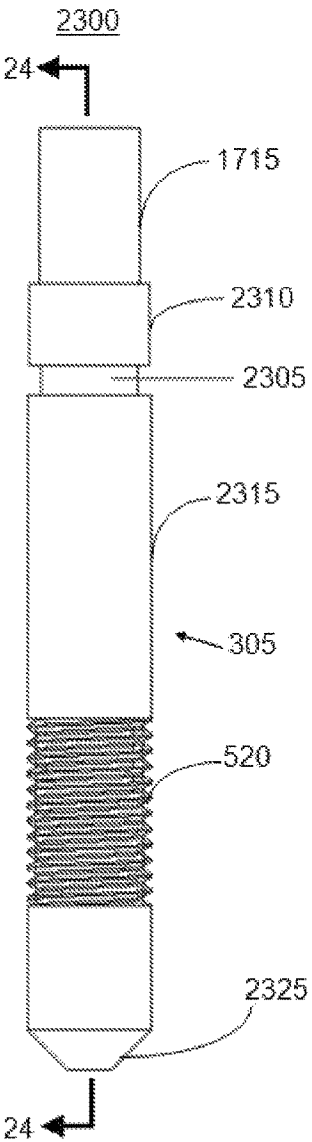
FIG. 23 depicts a top view of an unthreaded male complementary member with a flat groove or recess in its body and a chamfered end portion.

Complementary member 305 is an elongated solid or tubular shaft that has, in some embodiments, an overall length of 4.5 inches with a range of 20-407 mm and a diameter of % inch with a range of 6-153 mm. These measurements can also be changed without departing from the teachings of this disclosure. In some embodiments, complementary member 305 has a beveled end portion 525. As depicted in FIG. 7 and subsequent figures, complementary member 305 may have a rounded end portion 715, while in other embodiments, as depicted in FIG. 9 and subsequent figures, complementary member 305 has a flat end portion 915, while still yet in other embodiments, as depicted in FIG. 23 and subsequent figures, complementary member 305 has a chamfered end portion 2325. The shaping of the end portion of the complementary member 305 by rounding, beveling, or chamfering allows for easier insertion into an aperture 405 when assembling with a shelf 120.

In one embodiment, complementary member 305 incorporates a friction fit feature 520, with a length of ½ inch and a range of 3-407 mm, along its shaft. Different embodiments may use different measurements without departing from the teachings of this disclosure. The friction fit feature 520 is a rough surface along the shaft of the complementary member 305 for the purpose of providing friction between the universal mounting bracket 125 and the apertures 405 of the shelf 120 when assembled on a vertical surface 110. This friction helps keep the shelf 120 secure to the universal mounting brackets 125 to prevent it from falling off or accidentally being removed, thereby making the shelf assembly 115 snug and retained against the vertical surface 110. An adhesive or other binding compound such as silicone or wax, in order to help prevent the shelf 120 from pulling off the universal mounting brackets 125, may be applied to the apertures 405 of the shelf 120 or the shaft of complementary member 305 or the friction fit feature 520 before assembling the components to form the shelf assembly 115. This friction fit feature 520, shown in the drawings as threading, may take the form of threading, knurling, or other texturing, which is either applied to or cut into the shaft of the complementary member 305. The friction fit feature 520 essentially provides a mechanical grip for the shaft of the complementary member 305 onto the walls of the aperture 405 in which it is placed. As stated, a user may increase that grip with an adhesive or the like. The friction fit feature 520 may not be present in some embodiments, for example, if the universal mounting bracket 125 was used to mount a shelf 120 made from marble, or other stone, a smooth shaft on complementary member 305 would be required, and an adhesive or other biding agent would be relied upon to keep the universal mounting bracket 125 secured into the apertures 405.

Figures 17, 18:
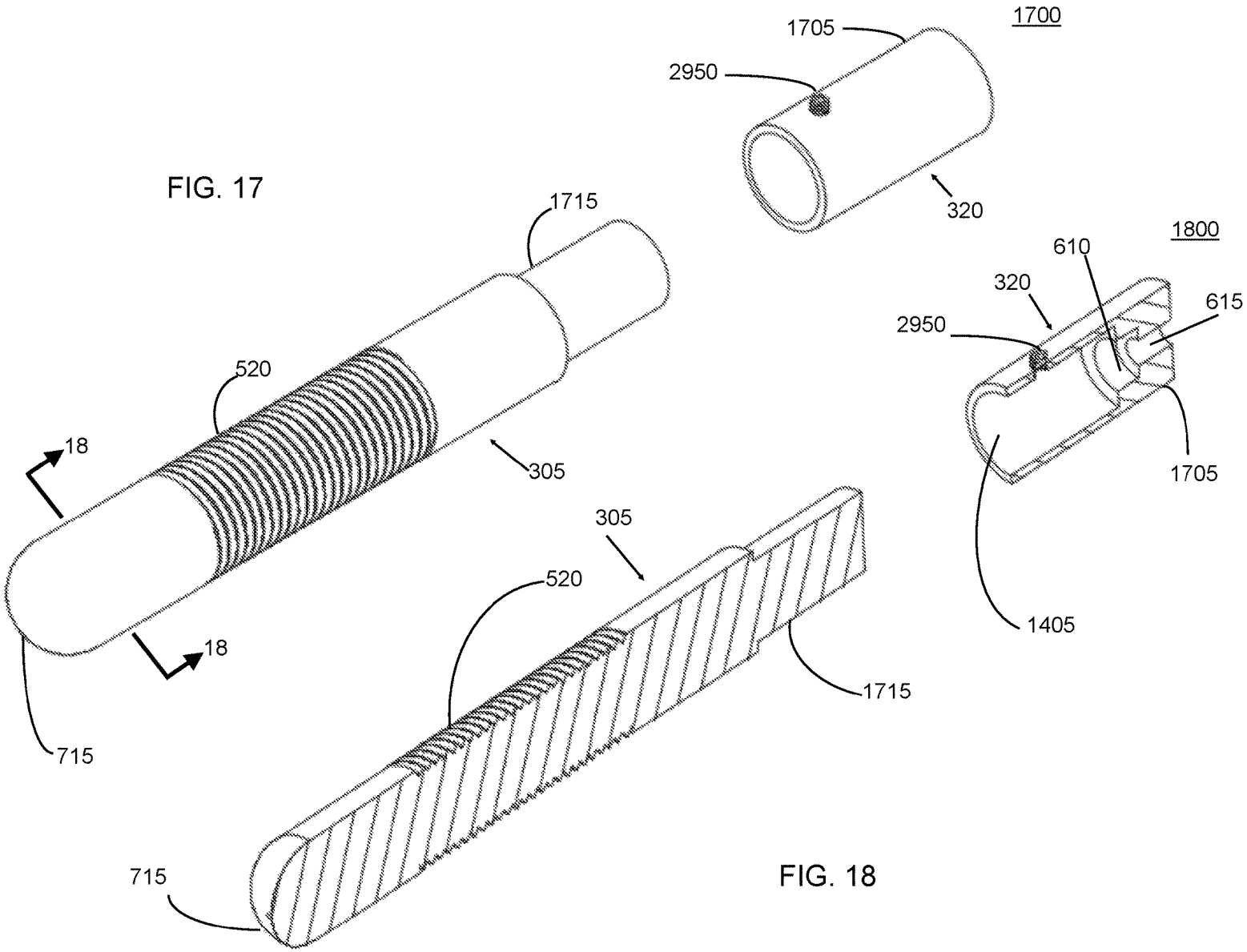
FIG. 17 depicts a perspective view of an unthreaded female base member with an aperture accommodating a flush set screw and an unthreaded male complementary member.
FIG. 18 depicts a cross-section of the unthreaded female base member with an aperture accommodating a flush set screw and an unthreaded male complementary member taken along the line 18-18 of FIG. 17.

FIG. 6 depicts a cross-section of the mounting bracket apparatus taken along the line 6-6 of FIG. 5 according to an embodiment of the present disclosure. The shaft of complementary member 305 will have, as a permanent feature, an associated coupling portion across all embodiments in either a male or female configuration in order to be able to assemble with base member 320 to create the universal mounting bracket 125 for use in the shelf assembly 115. FIG. 6 presents a threaded female complementary coupling portion 605 with a depth of 1 inch, with a range of 6-153 mm and a diameter of ⅝ inch with a range of 6-150 mm. Different embodiments may use these same or different measurements without departing from the teachings of this disclosure. Other embodiments of the coupling portion of base member 305 may have, as depicted in FIG. 7 and subsequent figures, a threaded male complementary coupling portion 710, while in other embodiments may have, as depicted in FIG. 12 and subsequent figures, a non-threaded female complementary coupling portion 1210, while still yet in other embodiments may have, as depicted in FIG. 17 and subsequent figures, a non-threaded male complementary coupling portion 1715.

Base member 320 incorporates a central bore 615 to accommodate the fastener 130 and a recessed area 610 in front of the central bore 615 to accommodate and conceal the fastener head 410. The central bore 615 passes through the entirety of base member 320 and has a diameter that measures 4 mm with a range of 2-77 mm. The depth of the recessed area 610 in front of the central bore 615, which will always be less than the overall length of base member 320, is 20 mm with a range of 0-150 mm. The diameter of the recessed area 610 in front of the central bore 615 is 9 mm with a range of 3-150 mm. The diameter of the recessed area 610 in front of the central bore 615 will always be of greater diameter than the central bore 615 and is, in essence, a counter bore or counter sink whose function is to allow the fastener head 410 to be concealed and also allow the fastener 130 to be installed deeper into the base member 320 for a more secure mechanical hold. As seen in FIG. 14, the recessed area 610 in front of the central bore 615 may have a dimensional depth of 0 mm without departing from the teaching of this disclosure. As stated previously in this disclosure, different embodiments may use different measurements without departing from the teachings of this disclosure.

According to an embodiment of the present disclosure, FIG. 7 depicts a base member 320 with a threaded female coupling portion and complementary member 305 with a threaded male coupling portion. This embodiment demonstrates how the roles of the segments or parts of universal mounting bracket 125 are interchanged. In this embodiment, base member 320, as depicted in FIG. 8 and subsequent figures, incorporates a threaded female base member coupling portion 805. Central bore 615 and recessed area 610 in front of the central bore, as disclosed supra, are both present in this embodiment of the base member 320, despite the gender of the coupling portion the base member 320 assumes. Complementary member 305 incorporates a threaded male complementary coupling portion 710 in this embodiment and contains friction fit feature 520. Also, as discussed supra, friction fit feature 520 takes different forms such as knurling in one embodiment, threading in another embodiment, and an applied texture in other embodiments. In this embodiment, complementary member 305 has a rounded end portion 715.

The base member 320 shown in this embodiment, containing central bore 615, recessed area 610 in front of the central bore, and threaded female base member coupling portion 805 may be referred to as a threaded female base 705. The complementary member 305 in this embodiment containing a threaded male complementary coupling portion 710 may be referred to as a threaded male complementary member 720. Thus, threaded female base 705 can couple together with threaded male complementary member 720 to create an assembled universal mounting bracket 125 consistent with the teachings herein.

The threaded male complementary coupling portion 710 is analogous in function to the threaded male base coupling portion 515. Therefore, the measurements of the threaded male base coupling portion 515 apply to threaded male complementary coupling portion 710.

FIG. 8 depicts a cross-section of a base member 320 with a threaded female coupling portion and complementary member 305 with a threaded male coupling portion, taken along the line 8-8 of FIG. 7, according to an embodiment of the present disclosure. In this view, threaded female base 705 clearly shows base member 320 with an incorporated threaded female base coupling portion 805, keeping the central bore 615 and recessed area 610 in front of central bore in its configuration.

The threaded female base coupling portion 805 is analogous in function to threaded female complementary coupling portion 605. Therefore, the measurements of threaded female complementary coupling portion 605 apply to threaded female base coupling portion 805.

Also shown on the complementary member 305 are the friction fit feature 520, threaded male complementary coupling portion 710, and a rounded end portion 715 of the threaded male complementary member 720.

According to an embodiment of the present disclosure, FIG. 9 depicts a base member with a threaded female coupling portion, a threaded male interconnecting member, and a complementary member with a female threaded coupling portion. This figure demonstrates the extreme flexibility of the universal mounting bracket 125 configurations. This embodiment introduces both threaded female base 705 and, as seen in FIG. 10, complementary member 305 with a threaded female coupling portion 605, which are coupled by assembly with interconnecting threaded male member 905. In this configuration, complementary member 305 has a flat end portion 915. This embodiment provides the best configuration to allow mass manufacture of the members of the universal mounting bracket 125 and for use with marble, granite, and other stone shelf 120 materials.

FIG. 10 depicts a cross-section of a base member with a threaded female coupling portion, a threaded male interconnecting member and a complementary member with female threaded coupling area taken along the line 10-10 of FIG. 9 according to an embodiment of the present disclosure. This figure more clearly shows both threaded female base 705 and complementary member 305 with a threaded female coupling portion 605, which are coupled by assembly with interconnecting threaded male member 905 in this embodiment. The length of interconnecting threaded male member 905 is circumscribed by the length of threaded female complementary coupling portion 605 and threaded female base member coupling portion 805.

Figure 29:
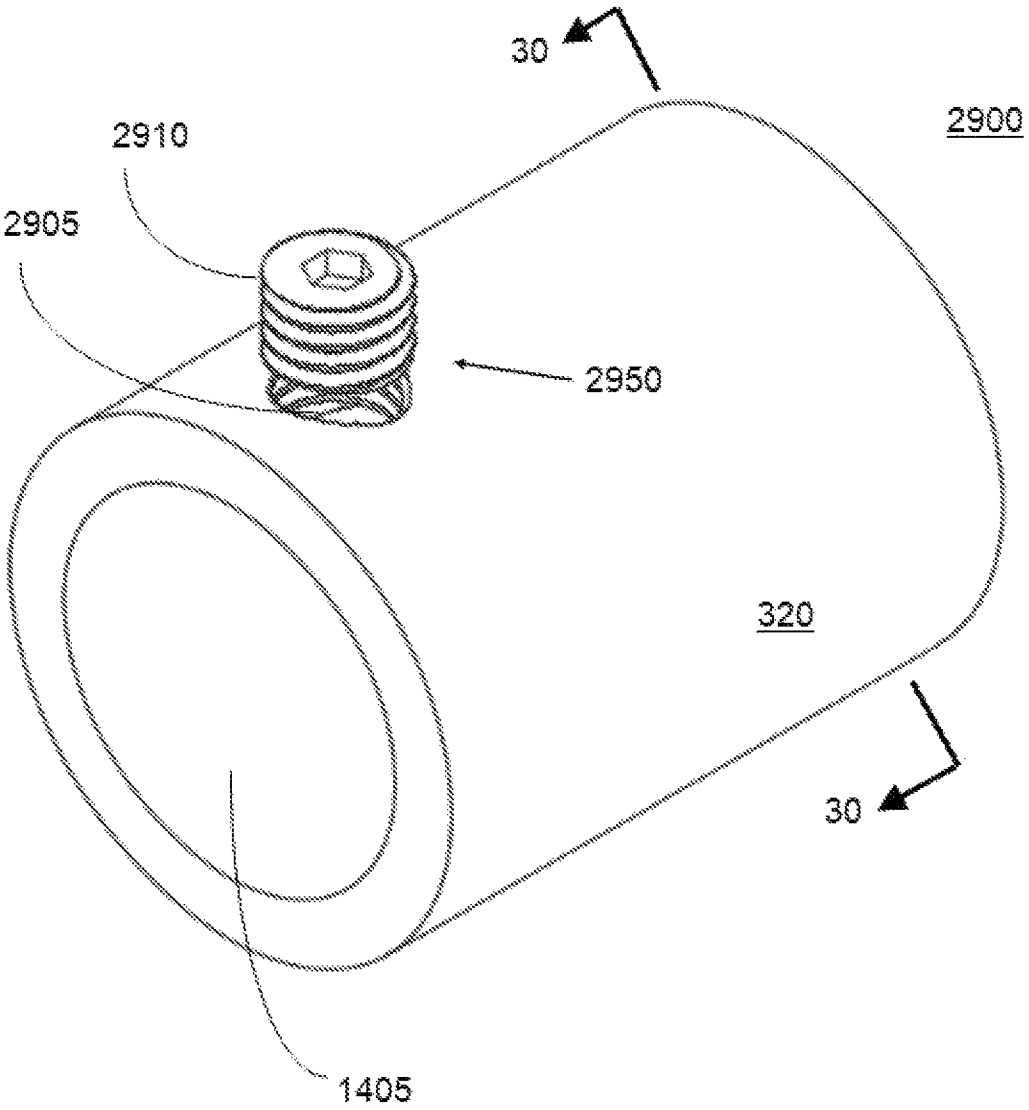
FIG. 29 depicts a perspective view of a base member with an aperture accommodating a flush set screw.

According to an embodiment of the present disclosure, FIG. 11 depicts an unthreaded male base member and unthreaded female complementary member with an aperture with a flush set screw to secure members together. The versatility of the different configurations or arrangements of universal mounting bracket 125 is further demonstrated in this embodiment. Both base member 320 and complementary member 305 contain an unthreaded coupling portion. Base member 320 is configured with a non-threaded male coupling portion 1105 sans a flange section 510. The diameter of this embodiment of the base member 320 is the same throughout its length. Complementary member 305 is configured with an aperture accommodating a flush set screw 2950, as depicted in FIG. 29 and subsequent figures. These components are described in greater detail with reference to respective drawings.

FIG. 12 depicts a non-threaded male base member and non-threaded female complementary member with an aperture for a flush set screw to secure members together taken along the line 12-12 of FIG. 11 according to an embodiment of the present disclosure. Complementary member 305 is configured in this arrangement with a non-threaded female complementary coupling portion 1210. The non-threaded female complementary coupling portion 1210 is analogous in function to threaded female complementary coupling portion 605. Therefore, the measurements of threaded female complementary coupling portion 605 apply to non-threaded female complementary coupling portion 1210. As shown, base member 320 is configured with a central bore 615 and recessed area 610 in front of central bore to accommodate a fastener 130 and fastener head 410, as previously discussed. Complementary member 305 is configured with an aperture accommodating a flush set screw 2950, as depicted in FIG. 29 and subsequent figures. These components are described in greater detail with reference to respective drawings.

According to an embodiment of the present disclosure, FIG. 13 depicts a non-threaded female base member, non-threaded male interconnecting member, and non-threaded female complementary member. This configuration of the universal mounting bracket 125 shows base member 320 and complementary member 305 configured with an aperture accommodating a flush set screw 2950 and an interconnecting non-threaded male member 1315. As depicted in FIG. 14 and subsequent figures, base member 320 is configured with a non-threaded female base coupling portion 1405. The base member 320 shown in this embodiment, containing central bore 615, recessed area 610 in front of the central bore, and non-threaded female base coupling portion 1405 and aperture accommodating a flush set screw 2950 may be referred to as a non-threaded female base 1305.

FIG. 14 depicts a cross-section of a non-threaded female base member, unthreaded male interconnecting member, and non-threaded female complementary member taken along the line 14-14 of FIG. 13 according to an embodiment of the present disclosure. As shown, base member 320 in this embodiment is configured with the non-threaded female base coupling portion 1405, central bore 615, recessed area 610 in front of central bore, and aperture accommodating a flush set screw 2950 and, as previously discussed, this configuration may be referred to as a non-threaded female base 1305. The dimensional depth of the recessed area 610 in front of central bore in this configuration may be of a 0 mm value, as the length of the non-threaded female base coupling portion 1405 may be of sufficient depth to not only allow accommodation of the interconnecting non-threaded male member 1315 but also to allow space for the accommodation of the length of the fastener head 410. The non-threaded female base coupling portion 1405 is analogous in function to threaded female complementary coupling portion 605. Therefore, the measurements of threaded female complementary coupling portion 605 apply to non-threaded female base coupling portion 1405. Complementary member 305 in this embodiment has a non-threaded female complementary coupling portion 1210, which contains an aperture accommodating a flush set screw 2950. The length of interconnecting non-threaded male member 1315 is circumscribed by the length of non-threaded female complementary coupling portion 1210 and non-threaded female base coupling portion 1405 in this embodiment. The two female members of this embodiment couple together over the interconnecting non-threaded male member 1315 and are secured by aperture accommodating a flush set screw 2950 onto the non-threaded male member 1315 to create the universal mounting bracket 125 disclosed herein.

Figures 15, 16:
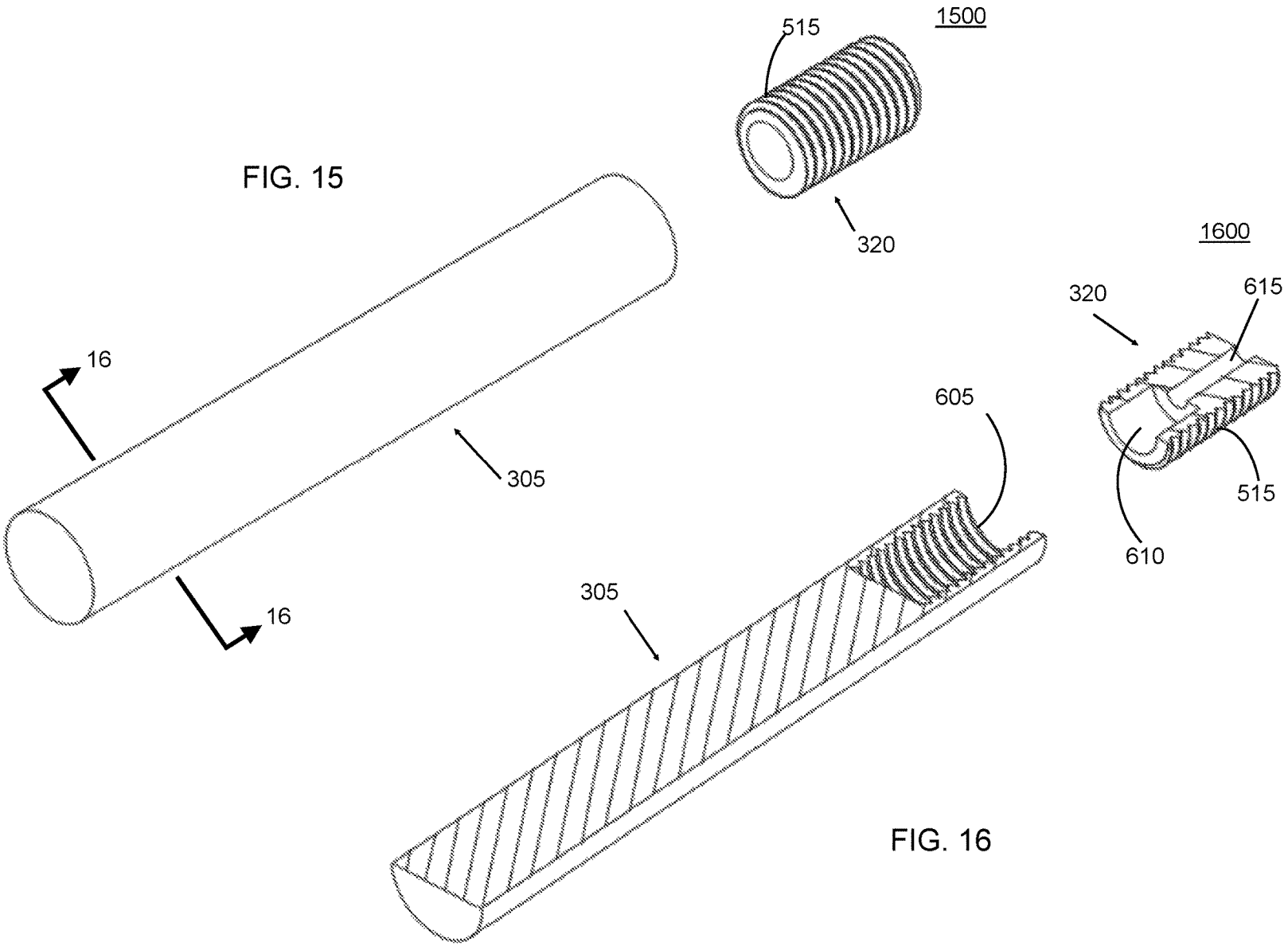
FIG. 15 depicts a threaded male base member and threaded female complementary member.
FIG. 16 depicts a cross-section of the threaded male base member and threaded female complementary member taken along the line 16-16 of FIG. 15.

FIG. 15 depicts a threaded male base member and threaded female complementary member according to an embodiment of the present disclosure. In this embodiment, base member 320 consists of a threaded male base coupling portion 515 sans flange section 510. The diameter of this embodiment of the base member 320 is the same throughout its length. Also shown is complementary member 305.

FIG. 16 depicts a cross-section of a threaded male base member and threaded female complementary member taken along line 16-16 of FIG. 15 according to an embodiment of the present disclosure. As shown, this embodiment of the base member 320 is configured with a recessed area 610 in front of the central bore and a central bore 615 to accommodate a fastener 130 and fastener head 410, as previously discussed. Also seen is the threaded male base coupling portion 515 sans flange section 510. Complementary member 305 is configured with a threaded female complementary coupling portion 605 to secure the two members together to assemble the universal mounting bracket 125.

According to an embodiment of the present disclosure, FIG. 17 depicts a non-threaded female base member with an aperture accommodating a flush set screw and a non-threaded male complementary member. The base member 320 is configured with a non-threaded female base coupling portion 1405 as shown more clearly in FIG. 18, and subsequent figures, recessed area 610 in front of central bore, central bore 615, and aperture accommodating a flush set screw 2950. This embodiment of the base member 320 may be referred to as a non-threaded female base 1705.

Complementary member 305 in this embodiment has a non-threaded male complementary coupling portion 1715, friction fit feature 520, and the rounded end portion 715.

FIG. 18 depicts a cross-section of an unthreaded female base member with an aperture accommodating a flush set screw and an unthreaded male complementary member taken along the line 18-18 of FIG. 17 according to an embodiment of the present disclosure. As shown, this embodiment of base member 320 is configured with a non-threaded female base coupling portion 1405, recessed area 610, the central bore 615, and aperture accommodating a flush set screw 2950. This embodiment of the base member 320 may be referred to as a non-threaded female base 1705 as discussed supra. Complementary member 305 in this embodiment contains a non-threaded male complementary coupling portion 1715, friction fit feature 520, and the rounded end portion 715.

Figures 19, 20:
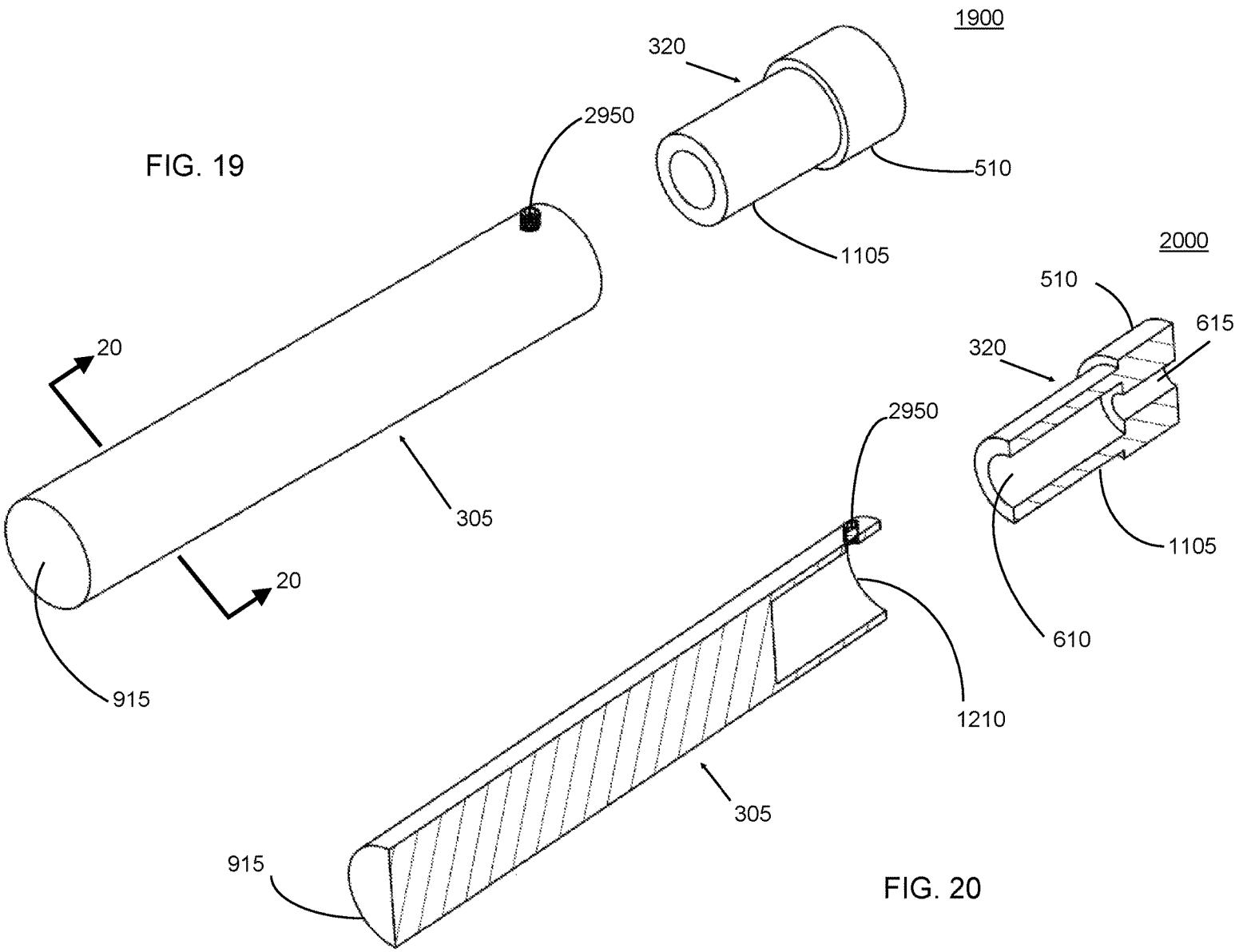
FIG. 19 depicts a perspective view of an unthreaded male base member and unthreaded female complementary member with an aperture accommodating a flush set screw.
FIG. 20 depicts a cross-section of the unthreaded male base member and unthreaded female complementary member with an aperture accommodating a flush set screw taken along the line 20-20 of FIG. 19.

FIG. 19 depicts an unthreaded male base member and an unthreaded female complementary member with an aperture accommodating a flush set screw according to an embodiment of the present disclosure. In this configuration, base member 320 consists of an unthreaded male base coupling portion 1105 and a flange section 510. Unthreaded male base coupling portion 1105 is analogous in function to the threaded male base coupling portion 515 and therefore shares the same dimensions set forth for threaded male base coupling portion 515 above. Complementary member 305 is configured with a flat end portion 915, and an aperture accommodating a flush set screw 2950 along with a non-threaded female base coupling portion 1210, as more clearly seen in FIG. 20.

FIG. 20 depicts a cross-section of an unthreaded male base member and an unthreaded female complementary member with an aperture accommodating a flush set screw taken along the line 20-20 of FIG. 19 according to an embodiment of the present disclosure. As shown, base member 320 is configured with a recessed area 610 in front of central bore 615, unthreaded male base coupling portion 1105, and a flange section 510. Complementary member 305 in this embodiment contains a flat end portion 915, an aperture accommodating a flush set screw 2950, and a non-threaded female base coupling portion 1210.

Figures 21, 22:
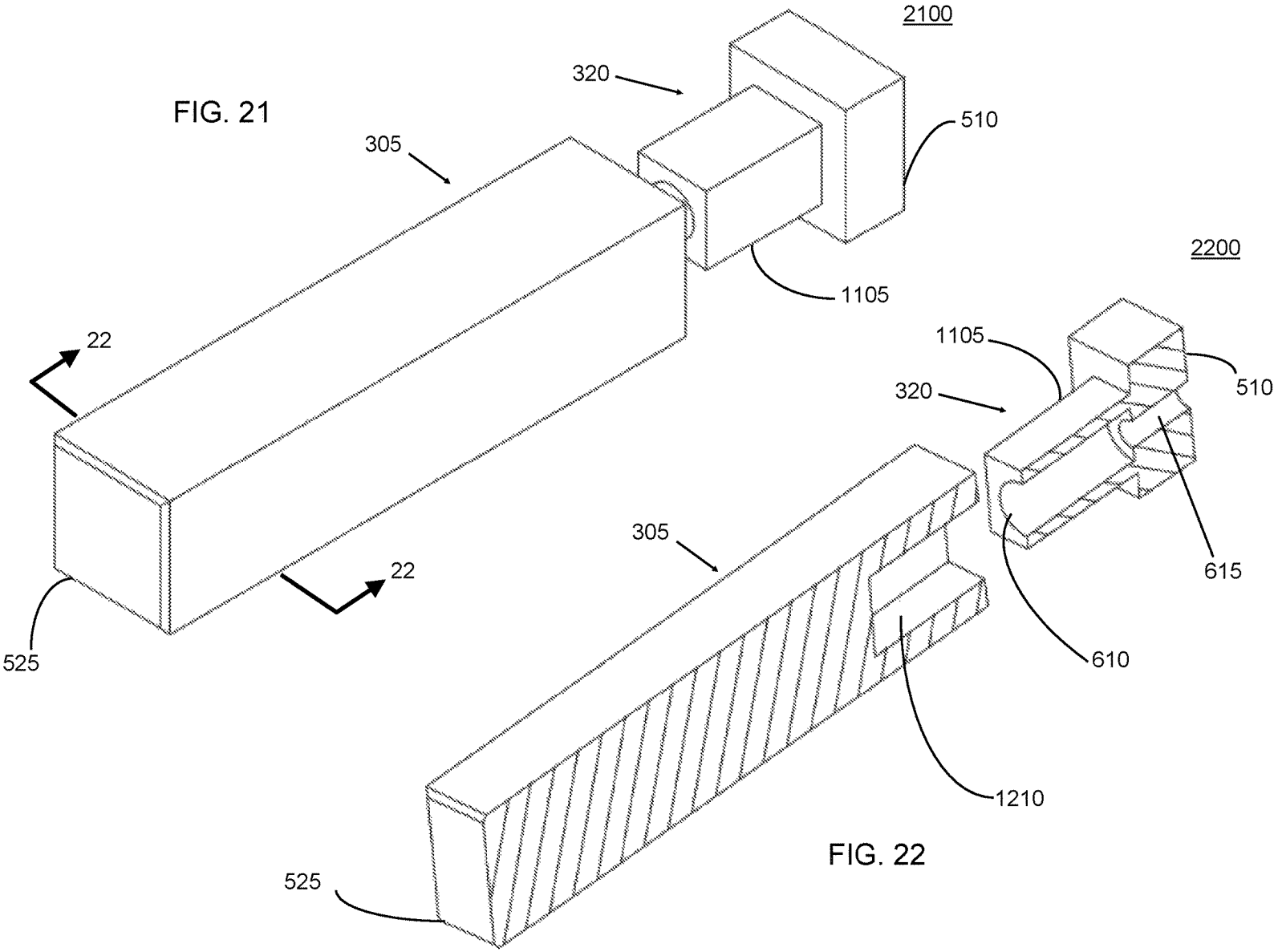
FIG. 21 depicts a perspective view an alternative geometry of the bracket assembly members whose coupling portions are to held together by adhesive.
FIG. 22 depicts a cross-section of the alternative geometry of the bracket assembly members whose coupling portions are to be held together by adhesive taken along the line 22-22 of FIG. 21.

FIG. 21 depicts an alternative geometry of the bracket assembly members whose coupling portions are secured together by adhesive according to an embodiment of the present disclosure. As depicted FIG. 21. shows a base member 320 and complementary member 305 with an alternative geometry to previous embodiments. Base member 320 is square in geometric shape; however, it still contains the flange section 510 and the non-threaded male base coupling portion 1105 as described supra. Complementary member 305 in this assembly is a square geometric profile and is rectangularly shaped in length with a beveled end portion 525.

FIG. 22 depicts a cross-section of an alternative geometry of the bracket assembly members whose coupling portions are secured together by adhesive taken along the line 22-22 of FIG. 21 according to an embodiment of the present disclosure. As shown and depicted, base member 320 contains the recessed area in front of central bore 610, central bore 615, flange section 510, and non-threaded male base coupling portion 1105, which are features of the base member 320 across several embodiments. Complementary member 305 contains a non-threaded female complementary coupling portion 1210 and the beveled end portion 525. Adhesive can be placed in the non-threaded female complementary coupling portion 1210 or on the non-threaded male base coupling portion 1105 to securely couple the two members of this embodiment together to form the universal mounting bracket 125.

FIG. 23 depicts a top view of an unthreaded male complementary member with a flat groove or recess in its body and a chamfered end portion according to an embodiment of the present disclosure. FIG. 23-26 show a complementary member 305 containing a non-threaded male complementary coupling portion 1715 and cut groove 2305 in its shaft. The shaft of complementary member 305 contains a wider portion 2310 and 2315 on either side of the cut groove 2305. The cut groove 2305 may be 1-204 mm in width, 1-110 mm in-depth, and may circumscribe the base member 305 or appear on the top, side, or bottom of the shaft depending on the geometry of the shaft. These measurements can change without departing from the teachings of this disclosure. The cut groove 2305 may be present to accommodate either a rubber or plastic O-ring or a set screw from the bottom of the shelf 120 when in a shelf assembly 115 in order to provide further security of the shelf 120 onto the universal mounting bracket 125. An O-ring helps provide friction while, alternatively, using a set screw provides mechanical locking of the shelf 120 onto the universal mounting bracket 125 at the cut groove 2305. Also shown is the friction fit feature 520 and chamfered end portion 2325. The chamfered end portion 2325 may come to a sharp point to allow a user to install the universal mounting bracket 125 to a vertical surface 110 and then hold shelf 120 material up to the mounted brackets and push the edge of the shelf 120 material onto the pointed chamfered end portions 2325 leaving a corresponding reference mark on the edge of the shelf 120 material which then can be easily referenced for drilling apertures 405. The shelf 120 material can then be cross cut to length and rip cut to depth, and the apertures 405 quickly drilled in the correct location so as to correspond to the installed universal mounting brackets 125 on the vertical surface 110, thereby facilitating subsequent assembly to create a shelf assembly 115. This allows for rapid fabrication of custom shelving onsite by a user who uses stock material sizes in larger installation jobs and is the fastest and easiest way to complete such a task across a large volume of the shelf assembly 115 installs with stock building materials. This is highly advantageous for onsite commercial production levels of custom shelving installations because a user is not limited by the type of wall assemblies at the site or the location on the wall assemblies they can install on and with minimal effort can fabricate custom shelf assemblies 115 with stock materials purchased in bulk, commonly done for economic reasons. There is no other bracket that provides these advantages and time savings.

Figure 24:
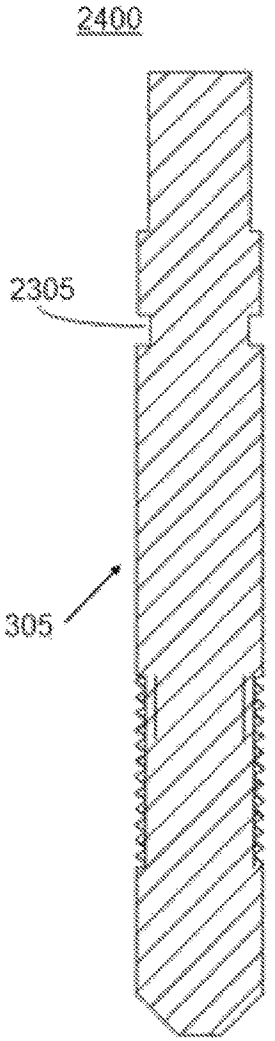
FIG. 24 depicts a cross-section of the top view of an unthreaded male complementary member with a flat groove or recess in its body and a chamfered end portion taken along the line 24-24 of FIG. 23.

FIG. 24 depicts a cross-section of the top view of an unthreaded male complementary member with a flat groove or recess in its body and a chamfered end portion taken along the line 24-24 of FIG. 23 according to an embodiment of the present disclosure. As shown, the cut groove 2305 is in the shaft of the complementary member 305.

Figures 25, 26:
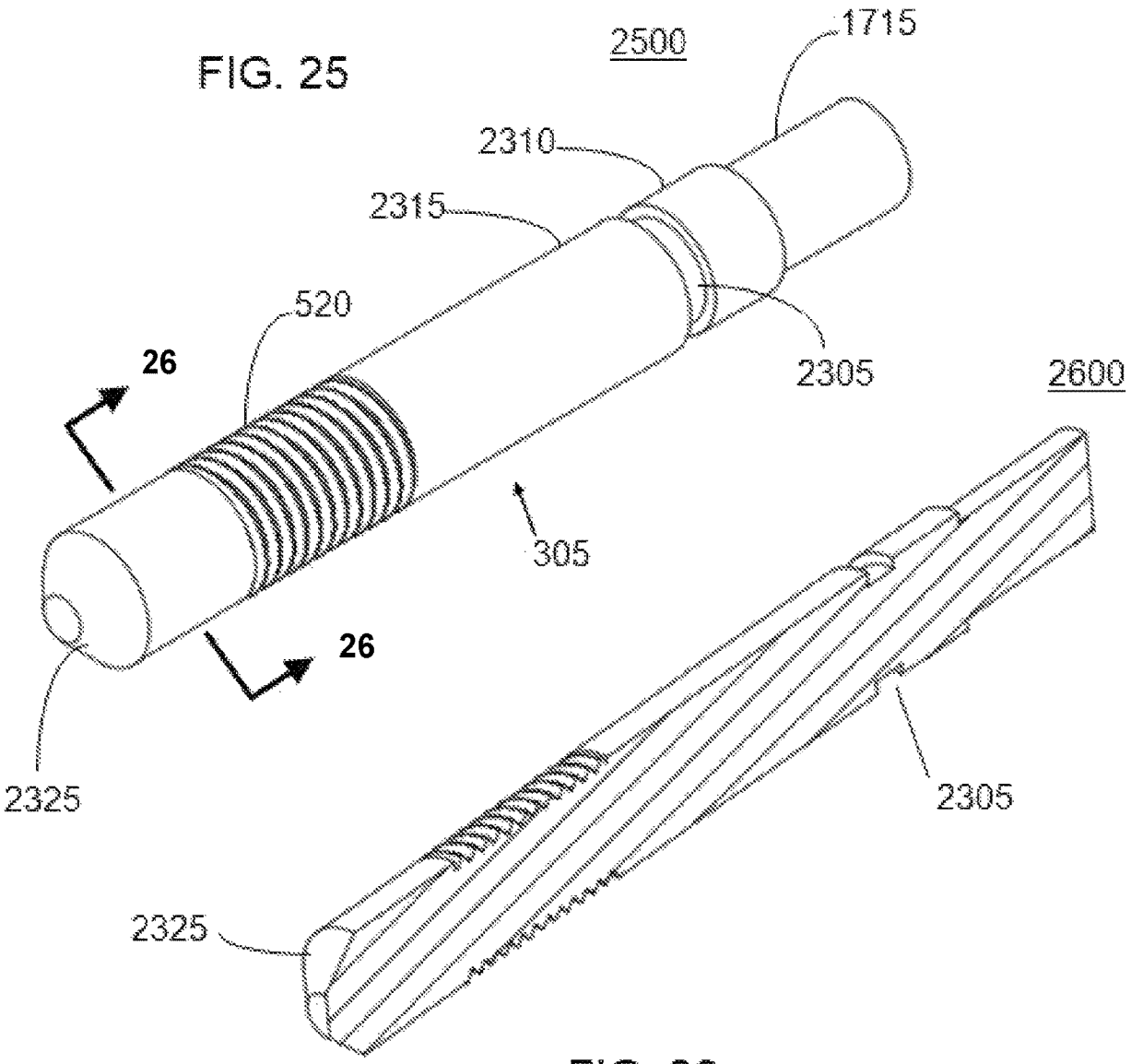
FIG. 25 depicts a perspective view of an unthreaded male complementary member with a flat groove or recess in its body and a chamfered end portion.
FIG. 26 depicts a cross section of the unthreaded male complementary member with a flat groove or recess in its body and a chamfered end portion taken along the line 26-26 of FIG. 25.

FIG. 25 depicts a perspective view of an unthreaded male complementary member with a flat groove or recess in its body and a chamfered end portion according to an embodiment of the present disclosure. This configuration shows a perspective view of assembly 2300, which shows the cut groove 2305 in base member 305 to accommodate an O-ring or set screw from the bottom of the shelf 120 material. Also shown are wider portion 2310 and 2315 of the shaft on either side of the cut groove 2305, the non-threaded male complementary coupling portion 1715, friction fit feature 520, and chamfered end portion 2325.

FIG. 26 depicts a cross-section of a perspective view of an unthreaded male complementary member with a flat groove or recess in its body and a chamfered end portion taken along the line 26-26 of FIG. 25 according to an embodiment of the present disclosure. Seen in more clarity are the cut groove 2305 and chamfered end portion 2325.

Figures 27, 28:
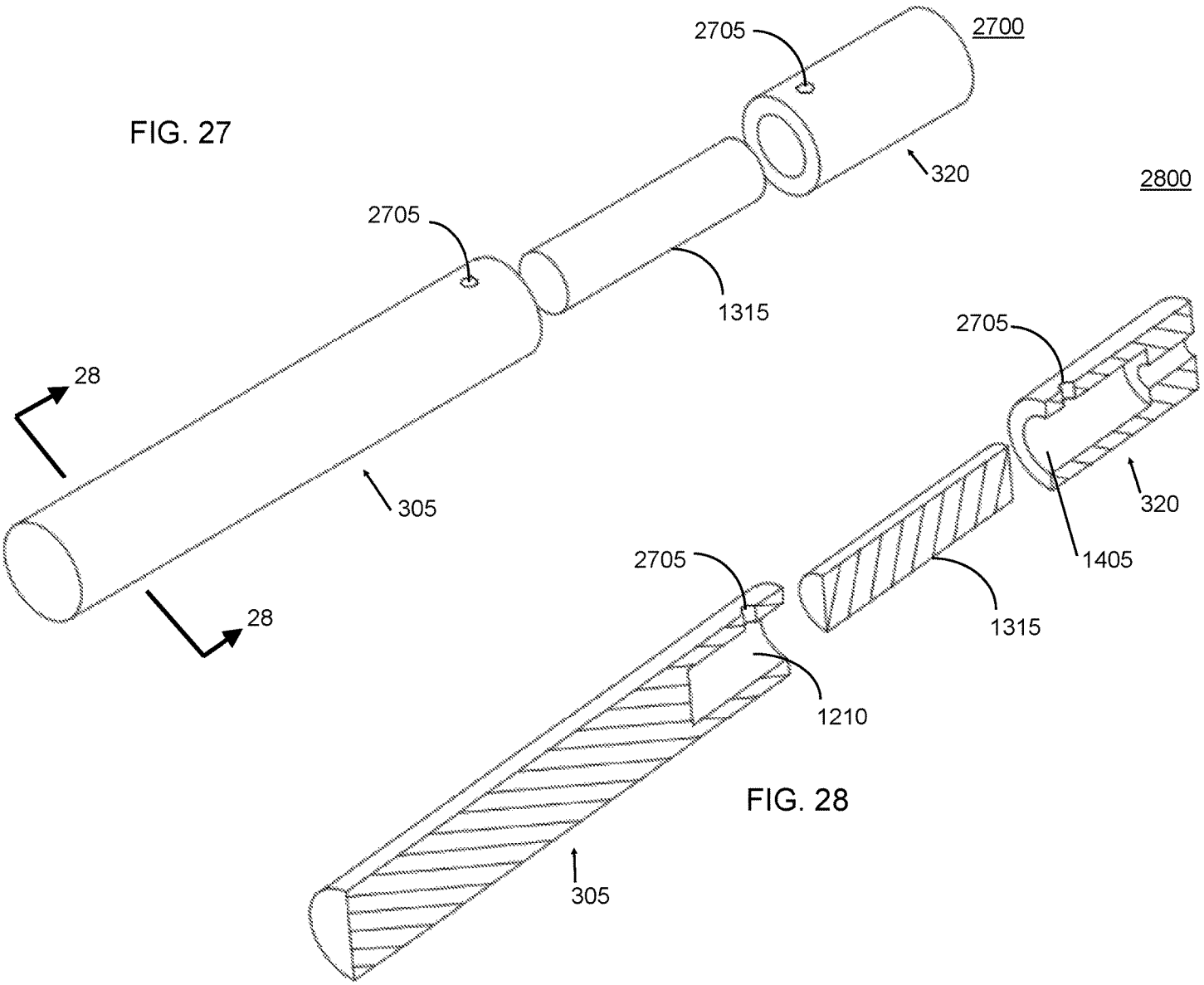
FIG. 27 depicts a perspective view of a universal mounting bracket with apertures in base and complementary members.
FIG. 28 depicts a cross section of the universal mounting bracket with apertures in base and complementary members taken along line 28-28 in FIG. 27.

FIG. 27 depicts an unthreaded female base member with aperture, unthreaded male interconnecting member, and unthreaded female complementary member with aperture according to an embodiment of the present disclosure. Here, both base member 320 and complementary member 305 are configured with a respective aperture 2705. Embodiments with unthreaded female coupling portions need a means to secure together to assemble the universal mounting bracket 125. Aperture 2705 in one embodiment accommodates a set screw, in another embodiment, aperture 2705 accommodates a pin. Interconnecting non-threaded male member 1315 may have a complementary boring to the aperture 2705 to allow a set screw or pin to seat through the aperture 2705 into the boring. Aperture 2705 has a diameter of 3 mm, with a range from 1-65 mm.

FIG. 28 depicts a cross-section view of an unthreaded female base member with aperture, unthreaded male interconnecting member, and unthreaded female complementary member with aperture taken along the line 28-28 of FIG. 27 according to an embodiment of the present disclosure. Aperture 2705 is placed on top of the base member 320 within the limits of the non-threaded female base coupling portion 1405 and along the top of complementary member 305 within the limits of the non-threaded female complementary coupling portion 1210. This placement allows the aperture 2705 to accommodate a pin or set screw that will press or slot into the interconnecting non-threaded male member 1315 when assembled with the base member 320 and complementary member 305 and securely couple the members together to create the universal mounting bracket 125.

FIG. 29 depicts an unthreaded female base member with an aperture accommodating a flush set screw according to an embodiment of the present disclosure. Base member 320 is configured with a threaded aperture 2905 and flush set screw 2910. The flush set screw 2910 secures into the threaded aperture 2905 and advances downward into the non-threaded female base coupling portion 1405 when tightened, thereby excreting a securing lock onto either an interconnecting non-threaded male member 1315 or non-threaded male complementary coupling portion 1715 of a complementary member 305 inserted into the non-threaded female base coupling portion 1405. The flush set screw 2910 is dimensioned to be able to tighten down flush with the body of the shaft of the base member 320 and does not protrude above the threaded aperture 2905. Threaded aperture 2905 shares the same dimensions as aperture 2705. Aperture accommodating a flush set screw 2950 comprises a threaded aperture 2905 and flush set screw 2910, which may present on top, side, or bottom, of either a non-threaded female base coupling portion 1405 or a non-threaded female complementary coupling portion 1210 as referred to in earlier portions of this disclosure.

Figure 30:
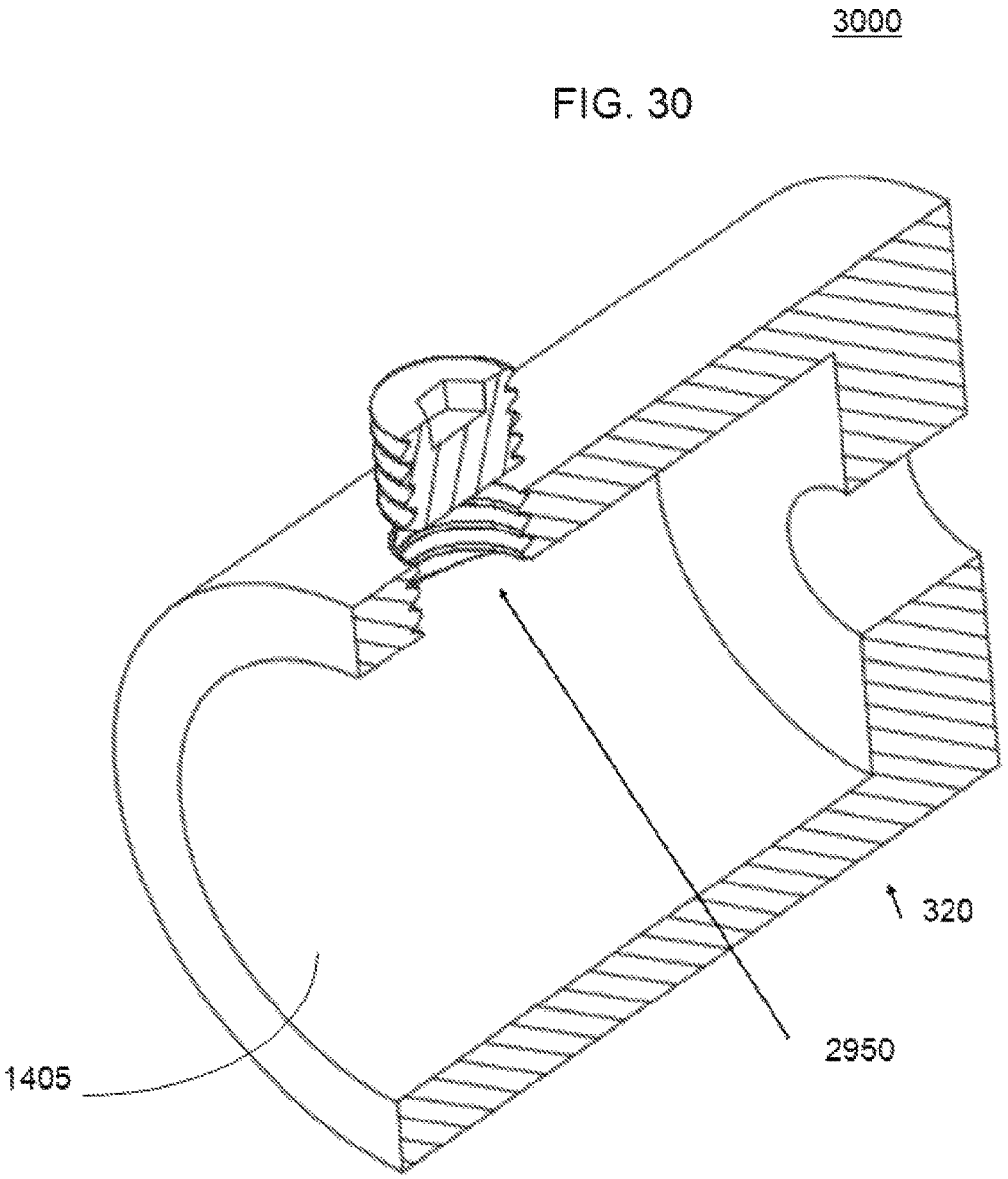
FIG. 30 depicts a cross section of the base member with an aperture accommodating a flush set screw taken along line 30-30 in FIG. 29.

FIG. 30 depicts a cross-section view of an unthreaded female base member with an aperture accommodating a flush set screw taken along the line 30-30 in FIG. 29 according to an embodiment of the present disclosure. More clearly seen in this figure is the aperture accommodating a flush set screw 2950 and how it relates to a non-threaded female base coupling portion 1405 in a base member 320.

Finally, the language used in the specification has been principally selected for readability and instructional purposes, and it may not have been selected to delineate or circumscribe the inventive subject matter. It is, therefore, intended that the scope of the disclosure be limited not by this detailed description but rather by any claims that issue on an application based thereon.

Although various embodiments, which incorporate the teachings of the present disclosure have been shown and described in detail herein, those skilled in the art can readily devise many other varied embodiments that still incorporate these teachings.

Dimensions for the disclosure are given in ranges that correlate with its most anticipated common uses, however, larger sizes may be used for all dimensional ranges given without departing from the teachings of this disclosure.

The invention claimed is:

1. A universal mounting bracket assembly, comprising:

a geometrically shaped base member having a type of coupling portion, wherein the geometrically shaped base member has a front end and a rear end, the rear end being on a wall-side and the front end being opposite the rear end;

a bore that extends through the geometrically shaped base member, in which the bore is adapted to receive a fastener that is inserted from the front end of the geometrically shaped base member and exits out the rear end to secure to a structure, the bore having a recessed area at a front portion of the geometrically shaped base member to accommodate the fastener's head, wherein the geometrically shaped base member's coupling portion substantially ends where the recessed area begins;

a geometrically shaped complementary member to the geometrically shaped base member having at its base a type of coupling portion, wherein the geometrically shaped complementary member has a greater length than the geometrically shaped base member; and wherein the coupling portion of the geometrically shaped base member is fitted to the geometrically shaped complementary member to thereby form a single bracket assembly.

2. The universal mounting bracket assembly of claim 1, wherein the coupling portion of the geometrically shaped base member is one or more of: an unthreaded male coupling, an unthreaded female coupling, a threaded male coupling, or a threaded female coupling.

3. The universal mounting bracket assembly of claim 1, wherein the coupling portion of the geometrically shaped complementary member is one or more of: an unthreaded male coupling, an unthreaded female coupling, a threaded male coupling, or a threaded female coupling.

4. The universal mounting bracket assembly of claim 1, wherein the coupling portion of the geometrically shaped base member located at the front portion of the geometrically shaped base member is of smaller surface area than a rear portion of the geometrically shaped base member.

5. The universal mounting bracket assembly of claim 1, wherein the geometrically shaped base member is of uniform surface area.

6. The universal mounting bracket assembly of claim 1, wherein a shape of an end of the geometrically shaped complementary member is one or more of: chamfer, flat, beveled, or round.

7. The universal mounting bracket assembly of claim 1, wherein the complementary member incorporates one or more recessed grooves on its length to respectively accommodate an O-ring or set screw from a shelf when assembled with the bracket.

8. The universal mounting bracket assembly of claim 1, wherein the complementary member incorporates a flattened portion on its length to accommodate a set screw.

9. The universal mounting bracket assembly of claim 1, wherein the center bore and the recessed area at the front portion of the geometrically shaped base member facilitates a fastener to be installed through the geometrically shaped base member to secure the geometrically shaped base member to a vertical surface in an orthogonal orientation to the vertical surface.

10. The universal mounting bracket assembly of claim 1, wherein a mechanism to fit and secure the geometrically shaped base member to the geometrically shaped complementary member is one or more of: threaded male to threaded female locking mechanism, using a flush set screw, a through screw or pin to secure an unthreaded male to an unthreaded female arrangement, using adhesive to secure an unthreaded male to an unthreaded female arrangement, using an interlocking threaded male coupling to secure a threaded female to a threaded female arrangement, using an unthreaded male coupling to interlock an unthreaded female to unthreaded female arrangement secured with a flush set screw, pin, through screw, or adhesive.

11. The universal mounting bracket assembly of claim 1, wherein the geometrically shaped complementary member has knurling, threading or other texture on a portion of its external surface.

12. The universal mounting bracket assembly of claim 1, wherein a uniform axial surface area extends from the rear end of the geometrically shaped base member to at least a portion of the geometrically shaped complementary member.

13. The universal mounting bracket of claim 1, wherein the recessed area revolves 360 degrees around the bore.

14. The universal mounting bracket of claim 1, further comprising a shelf having a hole inside which the geometrically shaped complementary member and geometrically shaped base member are inserted.

15. The universal mounting bracket of claim 14, wherein the hole is on an edge of the shelf, and the shelf's edge at least partially touches the structure.

16. A universal mounting bracket assembly, comprising:

a geometrically shaped base member having a type of coupling portion, wherein the geometrically shaped base member has a front end and a rear end, the rear end being on a wall-side and the front end being opposite the rear end;

a bore that extends through the geometrically shaped base member, in which the bore is adapted to receive a fastener that is inserted from the front end of the geometrically shaped base member and exits out the rear end to secure to a structure, the bore having a recessed area at a front portion of the geometrically shaped base member to accommodate the fastener's head;

a geometrically shaped complementary member to the geometrically shaped base member having at its base a type of coupling portion, wherein the geometrically shaped complementary member has a greater length than the geometrically shaped base member;

wherein the coupling portion of the geometrically shaped base member is fitted to the geometrically shaped complementary member to thereby form a single bracket assembly, in which an axial surface area is uniform; and a shelf having a hole inside which the geometrically shaped complementary member and geometrically shaped base member are inserted, and wherein the hole is on an edge of the shelf, and the shelf's edge at least partially touches the structure.

* * * * *